US005430468A

United States Patent [19]

Sasai et al.

[11] Patent Number: 5,430,468

[45] Date of Patent: Jul. 4, 1995

[54] IMAGE RECORDING APPARATUS

[75] Inventors: Keizo Sasai, Yokohama; Takehiro Yoshida, Tokyo; Masakatsu Iwata, Yokohama; Makoto Kobayashi, Tama; Minoru Yokoyama, Yokohama; Takashi Fuse, Noda; Hirohisa Sawada, Tokyo; Akihiro Tomoda, Kawasaki; Fumihiko Nakamura, Tokyo, all of Japan

[73] Assignee: Canon Kabushiki Kaisha, Tokyo, Japan

[21] Appl. No.: 853,961

[22] Filed: Mar. 19, 1992

[30] Foreign Application Priority Data

Mar. 20, 1991 [JP] Japan ..... 3-080643
Jul. 15, 1991 [JP] Japan ..... 3-173686

[51] Int. Cl.[6] ..... B41J 15/04; B41J 2/325

[52] U.S. Cl. ..... 346/136; 347/216; 347/134; 400/634; 400/636; 400/516; 400/703; 400/232

[58] Field of Search ..... 346/76 PH, 136, 134; 400/120, 634, 636

[56] References Cited

U.S. PATENT DOCUMENTS 4,768,063 8/1988 Kunishima et al. ..... 355/29
4,961,091 10/1990 Kasuya et al. ..... 355/321

FOREIGN PATENT DOCUMENTS 0411540 2/1991 European Pat. Off. .
57-83471 5/1982 Japan .
58-108175 6/1983 Japan .
58-134780 8/1983 Japan .
58-201686 11/1983 Japan .
60-236779 11/1985 Japan .
60-184165 2/1986 Japan .
61-141580 6/1986 Japan .
61-213182 9/1986 Japan .

*Primary Examiner*—Huan H. Tran
*Attorney, Agent, or Firm*—Fitzpatrick, Cella, Harper & Scinto

[57] ABSTRACT

A record head is energized in accordance with received image data to transfer an ink of an ink sheet to a record medium and perform image recording on the record medium while the ink sheet and the record medium are fed in opposite directions. The rotation period of a roller driven during feeding of the record medium or the feed direction of the record medium is detected to detect adhesion between the ink sheet and the record medium. When adhesion between the ink sheet and the record medium is detected, a recording operation is interrupted to feed the ink sheet and the record medium to release adhesion between the ink sheet and the record medium. When the adhesion is released within a predetermined time period, the recording operation is continued. When the adhesion is not released within the predetermined time period, an alarm sound is issued.

20 Claims, 19 Drawing Sheets

IMAGE RECORDING APPARATUS

BACKGROUND OF THE INVENTION

1. Field of the invention

The present invention relates to a sheet medium feed controller having a feed error detection function for a sheet medium and an image recording apparatus employing the feed controller.

2. Related Background Art

An elongated recording medium (to be also referred to as a sheet medium hereinafter) wound in a roll is generally used in a recording system of a conventional recording apparatus such as a facsimile apparatus or a printer, and recording is performed with a line record head line by line.

For example, in a recording apparatus shown in FIG. 23, a record sheet 50 supplied from a sheet roll 50*a* is fed to the sheet feed direction downstream side (to be simply referred to as the downstream side hereinafter) indicated by an arrow a by using a platen roller 51. An ink sheet 53 wound around a supply roll 52 is fed in a direction indicated by an arrow h and is taken up by a take-up roll 54. A record head 55 biased by a spring 55*a* from its rear surface is urged against the platen roller 51. The record head 55 is energized in accordance with record data to transfer an ink on the ink sheet 53 to the record sheet 50, thereby recording an image. A photo sensor 56 detects the presence/absence of the record sheet 50. A guide plate 57 is arranged opposite to the photo sensor 56. The guide plate 57 is made of a member having a lower reflectance than that of the rear surface of the record sheet 50. A cutter 58 is used to cut a record sheet 50 upon image recording of one page.

An operation of feeding the record sheet 50 in the recording apparatus will be described below. In a record standby state, as shown in FIG. 23, the leading end of the record sheet 50 stands by at an upstream position of the photo sensor 56 but at the downstream side of the platen roller 51. At this time, light emitted from the photo sensor 56 is reflected by the guide plate 57 and is incident again on the photo sensor 56. The level of the reflected light is defined as Low (to be simply referred to as "L" hereinafter).

When recording is started, the platen roller 51 and the take-up roll 54 are rotated to feed the record sheet 50 and the ink sheet 53 in the directions indicated by the arrows a and b, respectively, as shown in FIG. 24. The record head 55 is energized in accordance with record data, and recording is performed on the record sheet 50 in units of lines. When the leading end of the record sheet 50 passes by the photo sensor 56, light emitted from the photo sensor 56 is reflected by the rear surface of the record sheet 50 and is incident on the photo sensor 56. Since the rear surface of the record sheet 50 has a higher reflectance than that of the guide plate 57, the level of this reflected light is defined as High (to be simply referred to as "H" hereinafter).

When the platen roller 51 is rotated by a predetermined amount (i.e., until the leading end of the record sheet 50 is fed from the record standby position to the position of the photo sensor 56), and the input level of the photo sensor 56 is changed from L to H, normal feeding of the record sheet 50 is detected. If the input level is kept at L, a feed error of the record sheet 50 is detected.

When recording of one page is completed, the record sheet 50 is cut by the cutter 58, and the recorded record sheet 50 is ejected outside the apparatus. The leading end of the non-recorded record sheet 50 is fed to the upstream side upon reverse driving of the platen roller 51. The record sheet 50 is rewound to the record standby position shown in FIG. 23.

When recording, cutting, and rewinding are completed, and the input level of the photo sensor 56 is changed from H to L, normal feeding is detected. However, when the input level is kept at H, a feed error of the record sheet 50 is detected.

In the prior art described above, however, detection of a feed state of the record sheet 50 is performed at limited timings. More specifically, this detection is performed when the leading end of the record sheet 50 crosses the photo sensor 56 and when the leading end of the recorded record sheet 50 crosses the photo sensor 56 again. Therefore, the feed state of the record sheet 50 during recording cannot be performed.

For example, even if a trouble occurs in a driving source for the platen roller 51 during recording shown in FIG. 24 and the platen roller 51 is not rotated, the photo sensor 56 cannot detect this trouble. In this case, since the record sheet 50 is stopped, images are repeatedly recorded on the same portion of the sheet, and the recorded information cannot be read. In addition, since heat from the record head 55 is concentrated on one portion, the ink sheet 53 and the record sheet 50 may be damaged.

In order to solve this problem, there is a proposal in which an encoder is arranged at the platen roller 51. As described above, the record sheet 50 is fed in a direction opposite to that of the ink sheet 53. When a friction between the record sheet 50 and the ink sheet 53 becomes larger than that between the record sheet 50 and the platen roller 51, slippage occurs between the record sheet 50 and the platen roller 51 even if the platen roller 51 is normally rotated. As a result, the above problem is posed due to the stop of the record sheet 50. The record sheet 50 may be fed in the same direction as that of the ink sheet 53, i.e., in the direction indicated by the arrow b and may be wound around the take-up roll 54.

The above problem is also posed by a decrease in friction caused by a deterioration of the platen roller 51 over time or a variation in friction between the record sheet 50 and the ink sheet 53 due to changes in temperature and humidity. However, the above trouble cannot be detected by the encoder arranged at the platen roller 51.

The above trouble occurs due to adhesion between the ink sheet and record sheet. More specifically, the heat transfer printer described above uses an ink sheet obtained by coating a thermally meltable (or thermally sublimable) ink on a base film, and the ink sheet is selectively heated by a thermal head in accordance with an image signal. The melted (or sublimed) ink is transferred to record paper to perform image recording. This ink sheet is generally a sheet from which the ink is perfectly transferred in one image recording operation (so-called a one-time ink sheet). When recording of one character or one line is completed, the ink sheet is fed by a length corresponding to the record length, and an unused portion of the ink sheet must be located at the next recording position. For this reason, the amount of the ink sheet used is increased, and the running cost of the heat transfer printer tends to be increased as compared with a normal thermosensitive printer for performing printing on thermosensitive paper.

In order to solve the above problem, as disclosed in Japanese Laid-Open Patent Application Nos. 57-83471 and 58-201686 and Japanese Patent Publication No. 62-58917, there are proposed heat transfer printers in which record paper and an ink sheet are fed at different speeds.

As described in these prior-art inventions, an ink sheet (so-called multi-print ink sheet) capable of performing recording a plurality of times (n times) is known. If this ink sheet is used, when recording is continuously performed in units of record lengths L, the feed length of the ink sheet fed upon completion of recording of each image or during image recording can be set smaller than the length L (L/n for $n>1$). In this case, the efficiency of use of the ink sheet can be increased by n times the conventional case, and a reduction in running cost of the heat transfer printer can be expected. This record scheme is called a multiprint scheme.

In the multiprint scheme using the above ink sheet, the ink in an ink layer of the ink sheet is heated divisionally n times. Ink transfer is performed by a shear force generated between the melted ink and the nonmelted ink of the ink layer. For this reason, when the ink temperature is decreased due to an increase in time interval between recording of one line and recording of the next line, the shear force between the melted ink and the nonmelted ink is increased, and the ink sheet tends not to be easily released from the record paper. This typically occurs when a large number of black data are included in record data of one line. This poses a problem in a facsimile apparatus or the like in which the time interval between the current line and the next line is not constant and is relatively long. In the worst case, the ink sheet is adhered to record paper. When recording is continued in this state, the ink sheet is damaged, resulting in inconvenience.

SUMMARY OF THE INVENTION

The present invention has been made in consideration of the above situation, and has as its object to provide an improved trouble detecting unit and an image recording apparatus having this trouble detecting unit.

It is another object of the present invention to provide a feed controller capable of properly detecting a feed error of a sheet medium and an image recording apparatus having this feed controller.

It is still another object of the present invention to provide a feed controller capable of properly detecting adhesion between an ink sheet and a record medium and an image recording apparatus for recording an image by transferring an ink of an ink sheet to a record medium, the image recording apparatus being provided with this feed controller.

It is still another object of the present invention to provide an image recording apparatus capable of preventing a trouble in adhesion between an ink sheet and a record medium.

It is still another object of the present invention to provide an image recording apparatus capable of performing a release operation upon adhesion between an ink sheet and a record medium and continuing image recording.

The above and other objects, features, and advantages of the present invention will be apparent from the following description of preferred embodiments in conjunction with the accompanying drawings.

DETAILED DESCRIPTION OF THE PREFERRED EMBODIMENTS

An image recording apparatus according to an embodiment of the present invention will be described with reference to the accompanying drawings. The image recording apparatus of this embodiment is exemplified by a facsimile apparatus having a heat transfer print mechanism.

Figure 1:
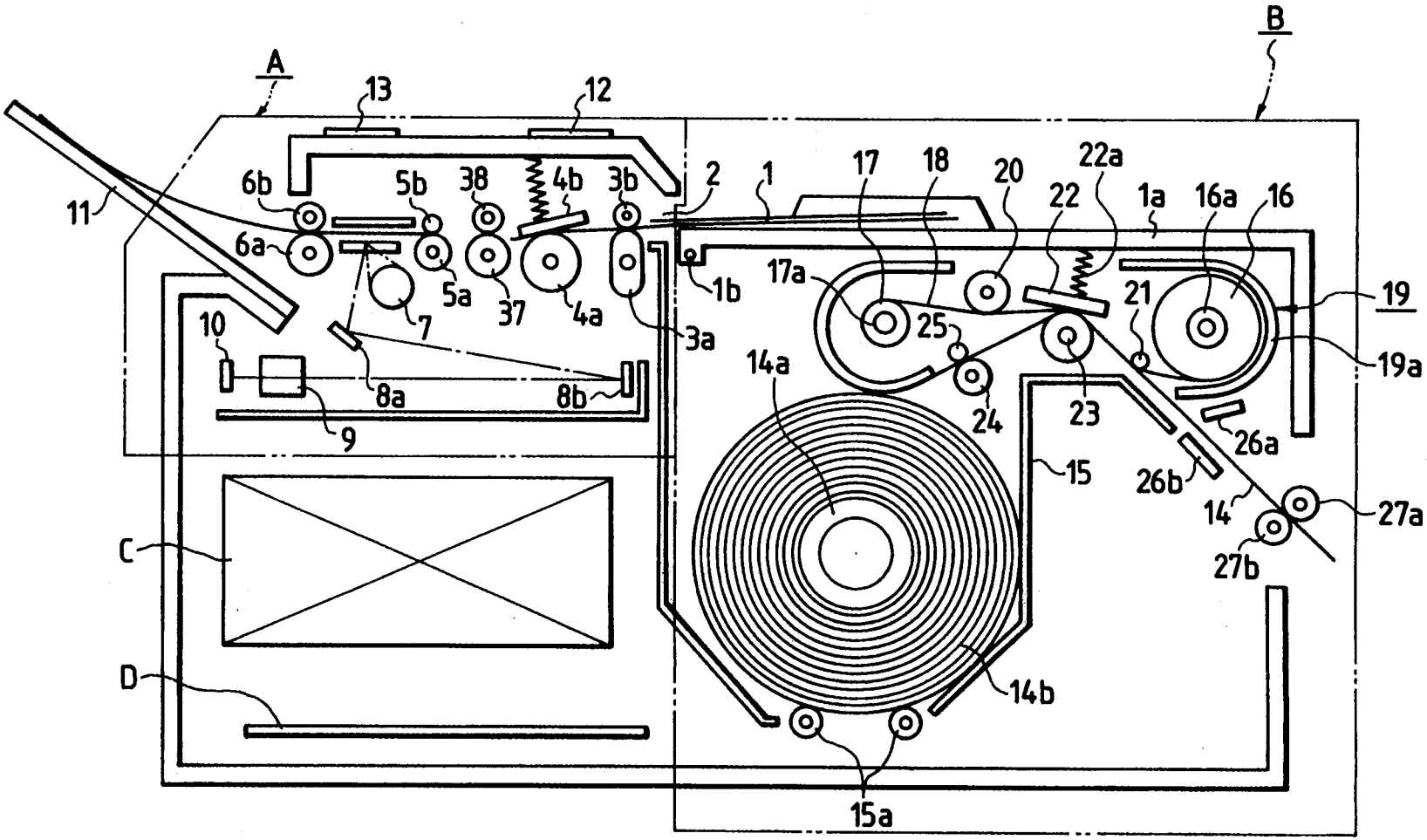
FIG. 1 is a sectional view for explaining a schematic arrangement of a facsimile apparatus.
Figure 2:
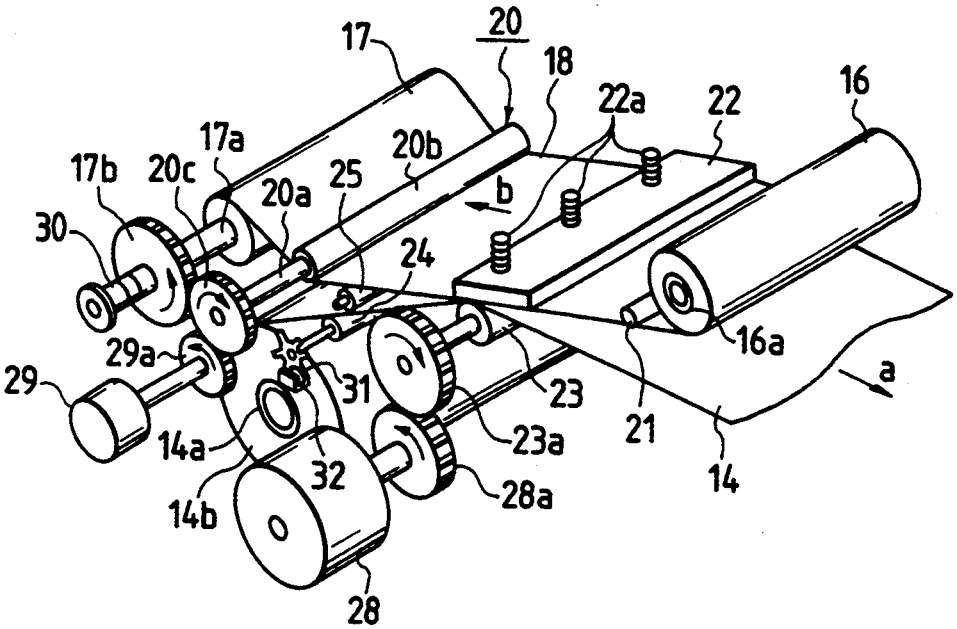
FIG. 2 is a perspective view for explaining a sheet medium feed unit.
Figure 3:
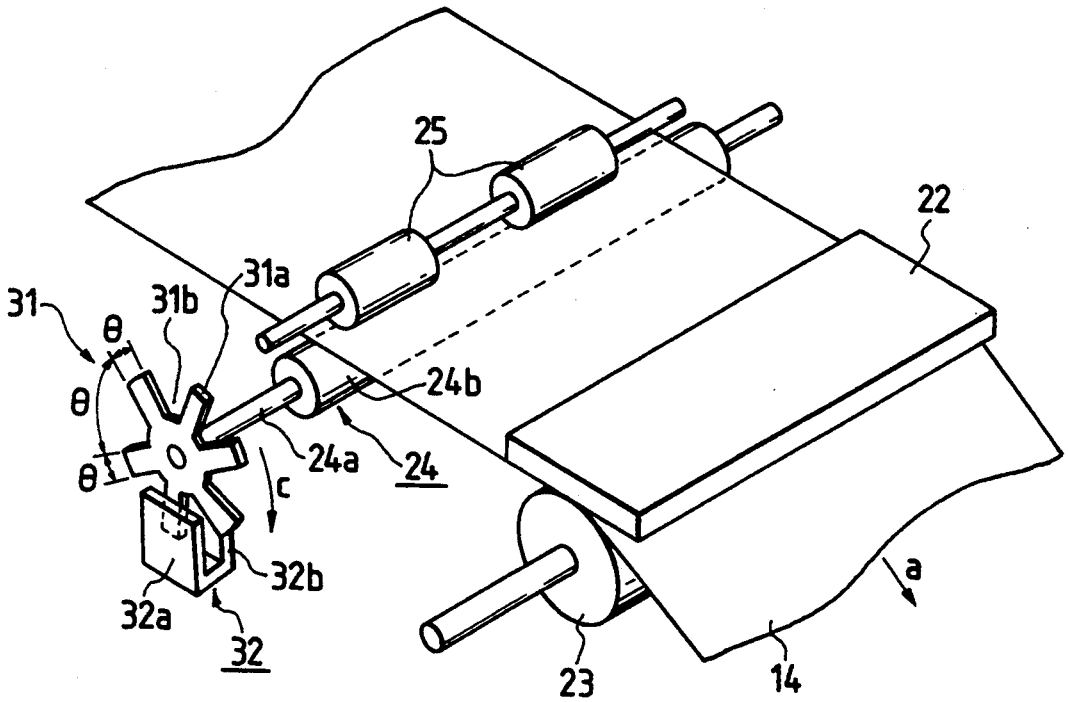
FIG. 3 is a view for explaining a main part of the sheet medium feed unit.
Figure 4:
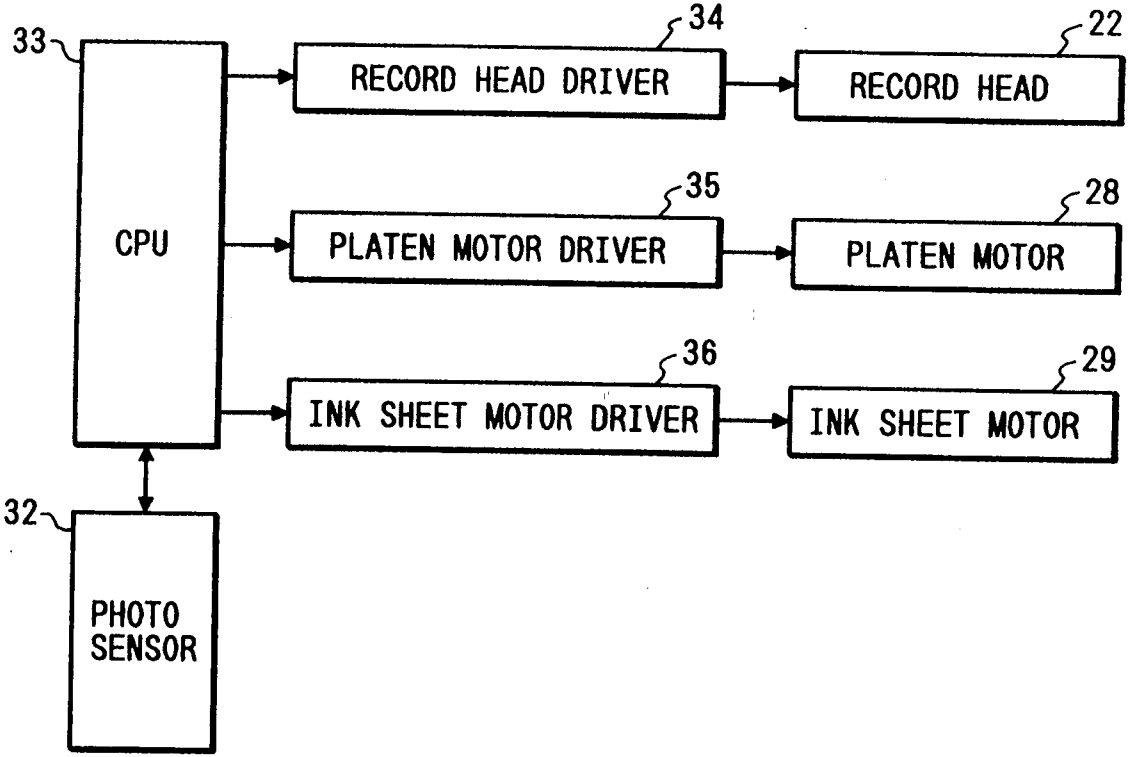
FIG. 4 is a block diagram showing a control means of the sheet medium feed unit.
Figure 5:
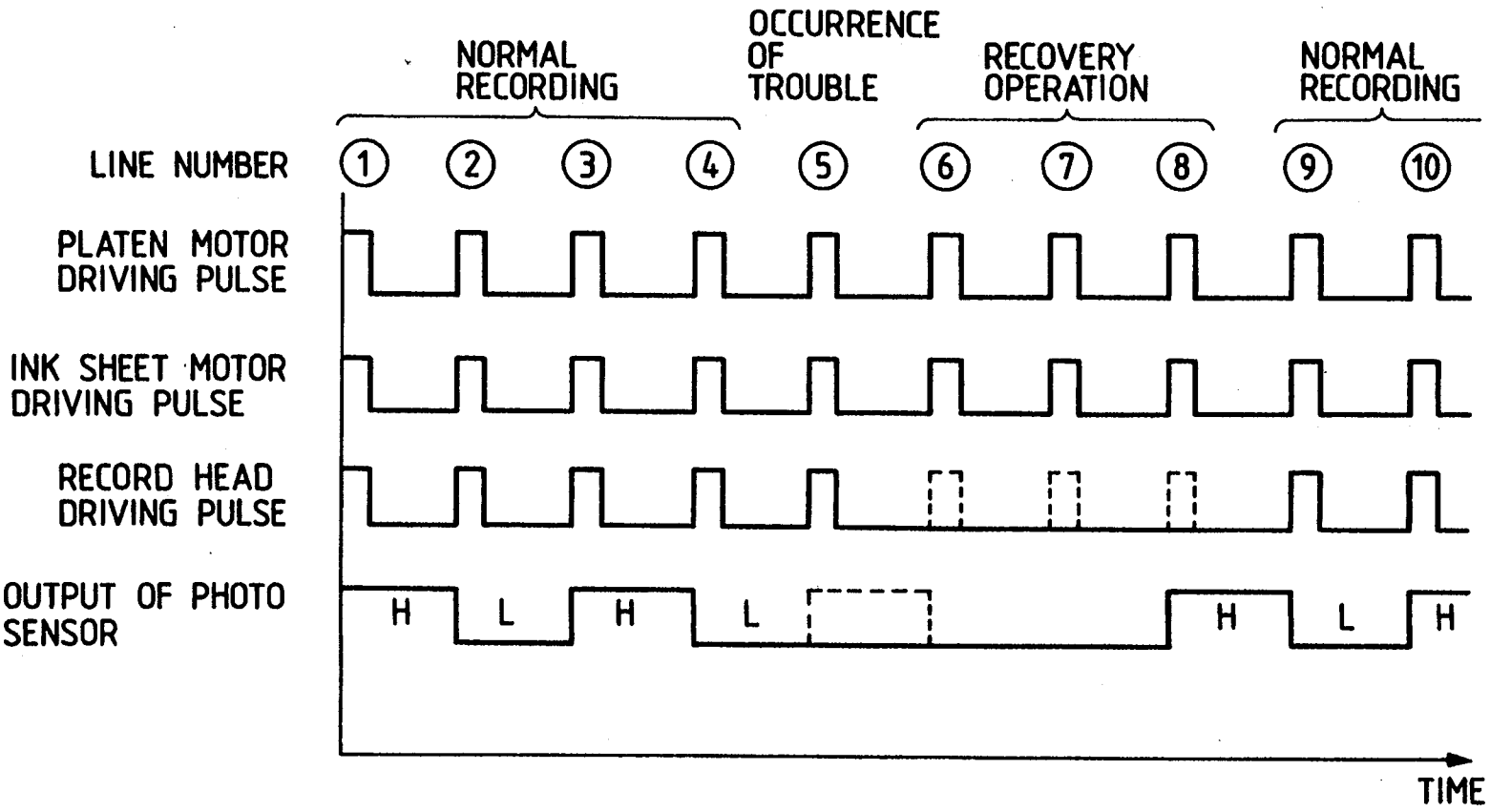
FIG. 5 is a timing chart showing a relationship between driving pulses for a recording/feeding means and output pulses from a rotation detecting means.
Figure 6:
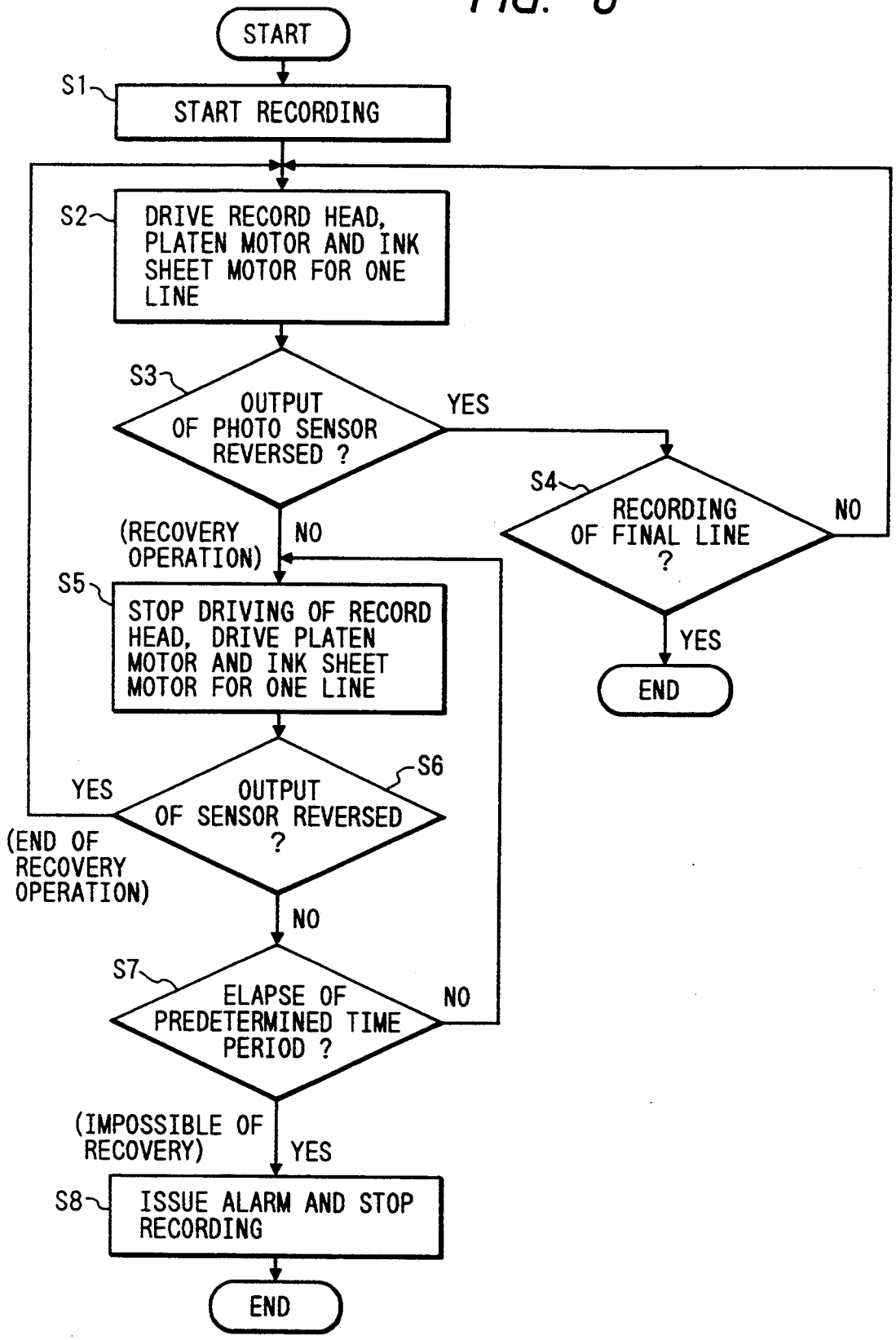
FIG. 6 is a flow chart showing a sheet medium feed operation.

FIG. 1 is a sectional view for explaining a schematic arrangement of the facsimile apparatus, FIG. 2 is a perspective view for explaining a sheet medium feed unit, FIG. 3 is a view for explaining a main part of the sheet medium feed unit, FIG. 4 is a block diagram of a control means, FIG. 5 is a timing chart showing a relationship between driving pulses for a recording/feeding means and output pulses from a rotation detecting means, and FIG. 6 is a flow chart showing a sheet medium feed operation.

The schematic arrangement of the facsimile apparatus will be described with reference to FIG. 1. This facsimile apparatus comprises an original reader A, a recorder B, a controller C, and a power supply D.

The original reader A will be described first. When an original 1 stacked on an original tray 1*a* serving as a stacker board also serving as an upper cover of the facsimile apparatus is fed from an original insertion port 2, the original is sequentially fed by a preliminary feed roller 3a and a preliminary driven roller 3b arranged in tight contact with the preliminary feed roller 3a. Each original is separated by a separation roller 4a and a separation press member 4b arranged in tight contact with the separation roller 4a. Each original is fed to the downstream side by a pair of feed rollers 5a and 5b and a pair of eject rollers 6a and 6b which are driven by an original feed motor (to be described later).

The original 1 fed to an image read position is irradiated with light from a light source 7, and light reflected by the original 1 is focused on a photoelectric conversion element 10 such as a CCD through a first reflecting mirror 8a, a second reflecting mirror 8b, and a lens 9. This optical signal is converted into an electrical signal by the photoelectric conversion element 10. In a facsimile mode, image data is transmitted to another recorder. In a copy mode, image data is transmitted to the recorder B (to be described in detail later). The original 1 is fed by the pair of eject rollers 6a and 6b upon image reading and is ejected on an eject tray 11 located near the original eject port.

A console unit 12 has function keys such as a transmission start key and a ten-key pad. A display 13 displays a state of an input from the console unit 12 and a sheet medium feed state. A switch for designating the type of an ink sheet 18 is arranged on the console unit 12. If this switch is set in an ON state, it indicates that the multiprint ink sheet 18 is loaded. However, if this switch is set in an OFF state, it indicates that a normal ink sheet 18 is loaded.

The recorder B will be described below. A sheet medium 14 uses elongated normal paper. A sheet roll 14b obtained by winding the sheet medium 14 around a core 14a is stored in a chute type roll holder 15. Auxiliary rollers 15a are disposed at the bottom portion of the roll holder 15 to easily rotate the sheet roll 14b during supply of the sheet. The number of auxiliary rollers 15a is at least one in contact with the sheet roll 14b. Since the weight of the sheet roll 14b acts on the auxiliary rollers 15b, slippage between the auxiliary rollers 15a and the sheet medium 14 can hardly occur, and the auxiliary rollers 15a assist rotation of the sheet roll 14b. Therefore, noise such as flapping noise of the sheet member can be prevented because the feed state of the sheet medium 14 is stabilized.

The ink sheet 18 is wound around an ink sheet supply roll 16. An ink sheet take-up roll 17 is used to take up the ink sheet 18. The ink sheet take-up roll 17 is driven by an ink sheet feed motor (to be described later) to take up the ink sheet 18 in a direction indicated by an arrow a. The ink sheet supply roll 16 and the ink sheet take-up roll 17 are loaded in an ink cartridge 19. The ink cartridge 19 is supported to be rotatable about cores 16a and 17a of the ink sheet supply roll 16 and the ink sheet take-up roll 17. The ink cartridge 19 is constituted by a cassette 19a constituting an outer case partially having an opening. A capstan roller 20 feeds the ink sheet 18, and a guide shaft 21 defines a feed path of the ink sheet 18.

A record head 22 serves as a recording means for recording an image on the sheet medium 14. Heater elements which are individually energized in accordance with record data are aligned in line in the record head 22. A rotatable platen roller 23 is disposed opposite to the record head 22 and serves as a feeding means for the sheet medium 14. The rear surface of the record head 22 is biased by a spring 22a and urges the platen roller 23 through the ink sheet 18 and the sheet medium 14.

The platen roller 23 is rotated to feed the sheet medium 14 in a direction indicated by an arrow b. In synchronism with this, heater elements of the record head 22 are energized to perform image recording.

An encoder roller 24 serving as a rotary member driven upon feeding of the sheet medium 14 and a press roll 25 for urging the encoder roller 24 through the sheet medium 14 are arranged on the upstream side of the record head 22 in the sheet feed direction. The rotation period of the encoder roller 24 is detected by a rotation detecting means (to be described later) to detect a feed state of the sheet medium 14.

Cutters 26a and 26b cut the recorded sheet medium 14. A pair of eject rollers 27a and 27b eject the cut sheet medium 14 outside the apparatus. The ink cartridge 19, the capstan roller 20, the guide shaft 21, the record head 22, and the biasing spring 22a are arranged on the side of the original tray la also serving as the upper cover of the apparatus. When the sheet medium 14 or the ink sheet 18 is to be replaced with a new one, the original tray la is rotated about a pivot point 1b to open the upper surface of the recorder B.

The sheet medium 14 supplied from the sheet roll 14b and the ink sheet 18 supplied from the ink sheet supply roll 16 are urged against the platen roller 23 by the record head 22 at the record position. At this time, heater elements of the record head 22 which correspond to an image signal are energized to record an image. The recorded sheet medium 14 is guided to the cutters 26a and 26b and the medium of one page is cut thereby. The cut sheet medium 14 is ejected outside the apparatus by the pair of eject rollers 27a and 27b.

The controller C controls the overall operation of the facsimile apparatus and includes various control boards, a modem board unit, and an NCU board unit. The power supply D supplies power to the entire apparatus.

A feed mechanism for the sheet medium 14 and the ink sheet 18 in the recorder B will be described with reference to FIGS. 2 and 3.

Referring to FIG. 2, in a state wherein the sheet medium 14 is set in the recorder B, the sheet medium 14 is supplied from the sheet roll 14b and can be fed while being clamped between the encoder roller 24 and the press roll 25 and then between the record head 22 and the platen roller 23. The ink sheet 18 is fed from the ink sheet supply roll 16 and is guided by the guide shaft 21. The ink sheet 18 is then clamped between the record head 22 and the platen roller 23 and is fed by the capstan roller 20 in the direction indicated by the array b. The ink sheet 18 is finally taken up by the ink sheet take-up roll 17.

A platen motor 28 drives the platen roller 23 to feed the sheet medium 14. The platen motor 28 comprises, e.g., a pulse motor which is driven in the forward or reverse direction to feed the sheet medium 14 in the directions indicated by the arrows a and b. An ink sheet motor 29 drives the take-up roll 17 and the capstan roller 20 to feed the ink sheet 18. The ink sheet motor 29 comprises, e.g., a pulse motor and feeds the ink sheet 18 in the direction indicated by the arrow *b*.

The capstan roller 20 comprises a core portion 20a and a rubber portion 20b formed around the core portion 20a. The rubber portion 20b is formed by spraying silicone rubber around the surface of the core portion 20a to a small thickness (e.g., 75 μm). The surface of the rubber portion 20b is formed to be highly smooth and has a high friction coefficient (2 or more) with the base film (e.g., a polyester film) formed on the rear surface of the ink sheet 18.

The platen motor 28 is meshed with a platen gear 23*a* mounted on a rotating shaft of the platen roller 23 through a motor gear 28*a*. The ink sheet motor 29 is meshed with a capstan gear 20*c* mounted at one end of the core portion 20*a* of the capstan roller 20 through a motor gear 29*a*. The capstan gear 20*c* is meshed with a free rotation take-up gear 17*b* which is coaxially mounted on the ink sheet take-up roll 17. A slip clutch unit 30 is mounted at the end of the shaft of the ink sheet take-up roll 17 to transmit only counterclockwise rotation of the take-up gear 17*b* to the ink sheet take-up roll 17.

Rotation of the platen motor 28 is transmitted to the platen roller 23 through the motor gear 28*a* and the platen gear 23*a*. Rotation of the ink sheet feed motor 29 is transmitted to the capstan gear 20*c* and the take-up gear 17*b* through the motor gear 29*a* and to the ink sheet take-up roll 17 through the slip clutch unit 30.

When the gear ratio of the capstan gear 20*c* to the take-up gear 17*b* is set so that the length of the ink sheet 18 taken up by the ink sheet take-up roll 17 is larger than that of the ink sheet 18 fed to the capstan roller 20, the ink sheet 18 fed to the capstan roller 20 is not loosened and can be taken up by the ink sheet take-up roll 17.

Any difference between the amount of the ink sheet 18 taken up by the ink sheet take-up roll 17 and the amount of the ink sheet 18 fed by the capstan roller 20 is absorbed by the slip clutch unit 30. Therefore, variations in feed speed of the ink sheet 18 which is caused by variations in take-up diameter of the ink sheet take-up roll 17 can be suppressed.

The rotation detecting means for detecting the rotation period of the encoder roller 24 will be described with reference to FIG. 3. The encoder roller 24 comprises a core portion 24*a* and a rubber portion 24*b*. The outer circumferential surface of the rubber portion 24*b* is in contact with the rear surface of the sheet medium 14. The press roll 25 causes the sheet medium 14 to urge against the encoder roller 24 by a spring (not shown) and its own weight. One end of the core portion 24*a* of the encoder roller 24 is mounted with a rotor wheel 31. This rotor wheel 31 is rotated together with the encoder roller 24. The rotor wheel 31 is split into a plurality of blades 31*a* and slits 31*b* formed between the blades 31*a* in the circumferential direction. The number of blades can be arbitrarily determined. In this embodiment, if an angle of rotation of the encoder roller 24 in correspondence with one-line feed of the sheet medium 14 is defined as 8, the blades 31*a* and the slits 31*b* have the same width and are located every 8.

A transmission photo sensor 32 serving as a rotation detecting means is arranged at a rotating position of the rotor wheel 31. The photo sensor 32 has a U-shaped section so that a light-emitting portion 32*a* and a light-receiving portion 32*b* oppose each other. When the encoder roller 24 is rotated, the blades 31*a* and the slits 31*b* of the rotor wheel 31 alternately pass between the light-emitting and light-receiving portions 32*a* and 32*b*. When a blade 31*a* is present between the light-emitting and light-receiving portions 32*a* and 32*b*, light emitted from the light-emitting portion 32*a* is shielded by the blade 31*a*. An input to the light-receiving portion 32*b* is set at Low (to be simply referred to as "L" hereinafter). However, when a slit 31*b* is present between the light-emitting and light-receiving portions 32*a* and 32*b*, light emitted from the light-emitting portion 32*a* is received by the light-receiving portion 32*b*. An input to the light-receiving portion 32*b* is set at High (to be simply referred to as "H" hereinafter).

An arrangement of the control means, arranged in the controller C, for controlling feed operations for the sheet medium 14 and the ink sheet 18 will be described with reference to the block diagram of FIG. 4. A CPU 33 serves as the control means for controlling the recorder B. The CPU 33 is constituted by a known microcomputer incorporating a ROM and a RAM. The CPU 33 receives an H or L output signal from the light-receiving portion 32*b* of the photo sensor 32. The CPU 33 outputs driving pulses to a record head driver 34, a platen motor driver 35, and an ink sheet motor driver 36 to drive the record head 22, the platen motor 28, and the ink sheet motor 29. The CPU 33 performs comparison and arithmetic operations (to be described later) between detection results from the photo sensor 32 and the driving inputs to the feeding means. When a feed error of the sheet medium 14 is detected in accordance with the arithmetic results, the CPU 33 performs a recovery operation to correct the feed state or signals an error state to a user as needed.

FIG. 5 is a timing chart showing a relationship between driving pulses input to the record head 22, the platen motor 28, and the ink sheet motor 29 and pulses output from the photo sensor 32 in a recording/feeding operation from the first to tenth lines.

In this embodiment, when a normal recording/feeding operation is performed from the first line to the fourth line, and an error (e.g., an ink on the ink sheet 18 is not transferred to the sheet medium 14 and the ink sheet 18 is not released from the sheet medium 14, so that feeding of the sheet medium 14 in the direction indicated by the arrow a is interrupted) occurs on the fifth line, this error is detected by the output from the photo sensor 32. A recovery operation is performed during feeding from the sixth to eighth lines. A normal recording/feeding operation is restored from the ninth line.

A recovery operation upon detection of an error during recording/feeding of the sheet medium 14 will be described with reference to a flow chart in FIG. 6.

When recording is started in step S1, the flow advances to step S2 to drive the record head 22, the platen motor 28, and the ink sheet motor 29 for one line, so that the sheet medium 14 and the ink sheet 18 are fed for one line. At the same time, the record head 22 is driven to transfer an ink to the sheet medium 14 to perform recording of one line.

The flow advances to step S3 to determine whether an output from the photo sensor 32 is reversed or inverted. If the output signal is reversed, it is determined that a normal recording/feeding operation is performed. In this case, the flow advances to step S4 to determine whether recording is performed for the final line. If recording is for the final line (if YES in step S4), recording is ended. If subsequent recording is required (i.e., if NO in step S4), the flow returns to step S2 to continue the recording/feeding operation.

When it is determined in step S3 that the output signal from the photo sensor 32 is not reversed, a feed error of the sheet medium 14 is detected, and a recovery operation from step S5 is performed. In step S5, in order to prevent ignition caused by abnormal heating of the record head 22, the record head 22 is stopped. At the same time, in order to release the ink sheet 18 from the sheet medium 14, the platen motor 28 and the ink sheet motor 29 are driven for one line. At this time, in order to properly release the ink sheet 18 from the sheet medium 14, a driving current and a driving voltage are preferably increased to increase the torques of the platen motor 28 and the ink sheet motor 29.

The flow advances to step S6 to determine whether the output signal from the photo sensor 32 is reversed. If the output signal is determined to be reversed, a normal recording/feeding operation is detected. In this case, the recovery operation is terminated, and the flow returns to step S2. The recording/feeding operation is started again.

However, when it is determined in step S6 that the output signal from the photo sensor 32 is not reversed, a feed error of the sheet medium 14 is detected. The flow advances to step S7. The recovery operation is repeated from step S5 until a predetermined time period elapses. When the elapse of the predetermined time period is detected in step S7, the recovery operation is determined to be impossible, and the recording/feeding operation is interrupted. The flow advances to step S8 to signal a feed error to the user by an alarm generated such that an alarm sound is generated using a buzzer or a message is displayed on the display 13.

The recovery operation is not limited to the one described in the above embodiment. Any method suitable for an arrangement of an apparatus and a feed error state of a sheet medium can be employed. For example, if a feed error is caused by the ink sheet 18, the ink sheet motor 29 is driven while the platen motor 28 is kept stopped. After the ink sheet 18 is driven by a predetermined amount, recording is started again.

Alternatively, after an ink on the ink sheet 18 is melted on the sheet medium 14 and is cooled, solidified, and adhered to the sheet medium 14, the platen motor 28 and the ink sheet motor 29 are stopped. The record head 22 is energized to melt the ink to release the ink sheet 18 from the sheet medium 14. Recording is then started again.

In addition, when a portion of the encoder roller 24 which contacts the sheet medium 14 is preferably made of a material having a high friction coefficient. A knurled groove may be formed or the contact surface is coarsely polished to reduce slippage between the contact surface and the sheet medium 14.

A recording operation of the recording apparatus having the above arrangement will be described below. The platen motor 28, the ink sheet motor 29, and the record head 22 are driven by the controller C to start recording.

When a predetermined number of pulses are input to the platen motor 28, the platen roller 23 is rotated by a predetermined amount, and the sheet medium 14 is driven for one line in the direction indicated by the arrow a in FIG. 1. At the same time, a predetermined number of pulses are input to the ink sheet motor 29 to rotate the capstan roller 20 by a predetermined amount, thereby feeding the ink sheet 18 in the direction indicated by the arrow b.

The record head 22 is energized and driven in accordance with record data, and a one-line ink on the ink sheet 18 is melted and transferred to the sheet medium 14. Every time recording of one line is completed, the respective components described above are driven to perform recording from the next line, thereby recording an image of one page. After recording, the sheet medium 14 is cut by the cutters **26*a* and 26*b* in units of pages. The cut sheet medium 14 is ejected by the eject rollers 27*a* and 27*b*** outside the apparatus.

An input to the photo sensor 32 is changed in accordance with a feed state of the sheet medium 14. For example, assume that one of the blades **31*a* of the rotor wheel 31 is located in the gap formed in the photo sensor 32 and that an input to the light-receiving portion 32*b* is set at L. In this case, as described above, when the sheet medium 14 is fed for one line in the direction indicated by the arrow a, the encoder roller 24 and the rotor wheel 31 are rotated together by an angle 8 in a direction indicated by an arrow c in FIG. 3. One of the slits 31*b* is located in the gap formed in the photo sensor 32, an input to the light-receiving portion 32*b* is set at H. When the sheet medium 14 is fed for one line, an input to the light-receiving portion 32*b*** is set at L again.

An input signal representing a rotation period of the encoder roller 24 and input to the photo sensor 32 is transferred to the controller C. The controller C detects the normal feed state of the sheet medium 14 because the inputs to the photo sensor 32 alternately change between H and L every time recording/feeding is performed for one line.

If the input to the photo sensor 32 does not change although the recording/feeding operation for one line of the sheet medium 14 is performed, a feed error of the sheet medium 14 is detected. The recording/feeding operation is interrupted, and the recovery operation is performed by the controller C. At the same time, an alarm sound is generated, a message is displayed on the display 13, or a lamp is turned on, thereby signaling the error to the user when a feed error is detected, an input current input to the platen motor 28 may be increased to increase the feed force, or the record head 22 may be released by a driving means (not shown), thereby performing the recovery operation.

In the above embodiment, the split number of the rotor wheel 31 is not limited to that in the above embodiment, and can be arbitrarily selected. Also, the input to the photo sensor 32 need not be changed in accordance with the record/feed operation of the sheet medium 14 in units of lines, but can be changed in accordance with the record/feed operation of the sheet medium 14 in units of a plurality of lines.

The rubber portion **24*b* of the encoder roller 24 need not have the same width as that of the sheet medium 14. The rubber portion 24*b* need only be in contact with part of the sheet medium 14. It is also possible to integrally form the core portion 24*a*, the rubber portion 24*b*, and the rotor wheel 31** by a material such as a plastic material.

It is also possible to arrange a rotor wheel 31 and a photo sensor 32 as in the encoder roller 24 at one end of each auxiliary roller **15*a*, so that the auxiliary roller 15*a* can have the same function as that of the encoder roller 24**.

In the above embodiment, the encoder roller 24 is arranged in the recorder B. However, as shown in FIG. 1, an encoder roller 37 and a press roll 38 may be arranged between the pair of feed rollers **5*a* and 5*b* and the pair of eject rollers 6*a* and 6*b* in the original reader A to clamp the original 1, thereby detecting a feed state of the original 1**.

In addition, it is possible to bring the encoder rollers 24 and 37 in contact with the record sheet medium 14 and the original 1, respectively, and to omit the press rolls 25 and 38. In this case, the sheet medium 14 at the platen roller 23 receives a friction caused by contact with the record head 22 and a back tension caused by the weight of the sheet roll 14*b*. For this reason, slippage occurs between the sheet medium 14 and the platen roller 23. However, since the encoder roller 24 is arranged separately from other rollers in the feed path of the sheet medium 14, other forces do not act on the sheet medium 14 at the encoder roller 24, thereby preventing slippage between the sheet medium 14 and the encoder roller 24. Therefore, the encoder roller 24 is rotated through an angle proportional to the feed amount of the sheet medium 14.

The original 1 also receives the friction resistance of the separation roller 4a and the separation press member 4*b* to cause slippage between the pairs of feed and eject rollers 5*a* and 5*b* and 6*a* and 6*b* and the roller 4*a* and the member 4*b*. However, since the encoder roller 37 is arranged separately from other rollers in the feed path of the original 1, no slippage occurs between the original 1 and the encoder roller 37. The encoder roller 37 is rotated through an angle proportional to the feed amount of the original 1. Therefore, in either case, the feed states of the sheet medium 14 and the original 1 can be accurately detected.

In the above embodiment, the sheet medium 14 and the ink sheet 18 are fed in opposite directions to perform a so-called multiprint operation. However, the present invention is also applicable to a one-time print operation in which the sheet medium 14 and the ink sheet 18 are fed in the same direction. The recording scheme is not limited to the heat transfer recording scheme, but can be applied to a thermosensitive scheme using a thermosensitive sheet. In addition, the feed means is not limited to a member in the form of a roller, but can be replaced with a member in another form such as a rotary belt.

Figure 7:
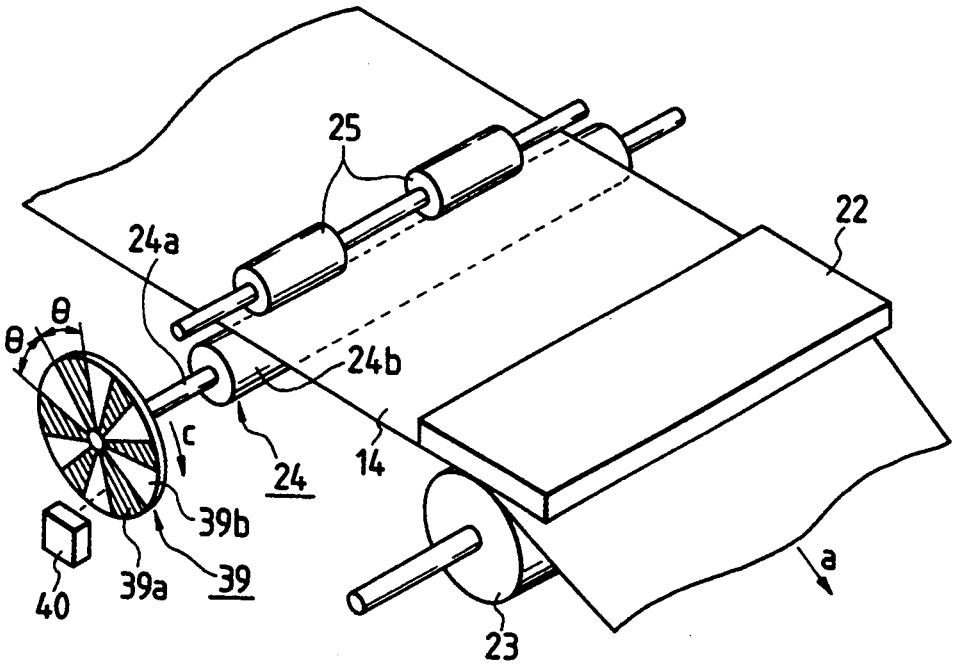
FIG. 7 is a view for explaining another arrangement of a rotation detecting means.

Another arrangement of the rotation detecting means for detecting the rotation period of the encoder roller 24 in the above embodiment will be described below with reference to FIG. 7.

In this arrangement, a disc 39 is arranged in place of the rotary wheel 31 at an end portion of the core portion 24*a* serving as a rotating shaft of the encoder roller 24. Black portions 39*a* and white portions 39*b* radially formed every predetermined angle $\theta$ are formed on a surface of the disc 39. The black and white portions 39*a* and 39*b* are printed so that they have different reflectances.

A reflection photo sensor 40 is arranged opposite to the surface of the disc 39. Light is incident from the photo sensor 40 on the black or white portion 39*a* or 39*b* of the disc 39, and the reflected light is received by the photo sensor 40. When the encoder roller 24 is rotated, the disc 39 is rotated accordingly. The photo sensor 40 alternately detects the black and white portions 39*a* and 39*b* and supplies output signals to the controller C, thereby detecting a feed state of the sheet medium 14 as in the above embodiment.

As described above, the sheet medium feed unit comprises the rotation detecting means for detecting the rotation period of a driven rotary body rotated during feeding of the sheet medium. The feed state of the sheet medium can always be detected regardless of the recording non-recording state.

In the above recording apparatus, since a feed error of the sheet medium is immediately detected, other apparatus troubles (e.g., jam in the recorder, running out of the ink sheet, damage to the record head, and a read error in the original reader) can be prevented beforehand, thereby improving reliability of the apparatus.

Another embodiment of the present invention will be described below. In the above embodiment, the rotation period of the roller rotated during feeding of the record medium is detected to detect a feed error. However, in this embodiment, the rotational direction of a platen roller is detected to detect a feed error such as adhesion between an ink sheet and a record medium, and its release operation is performed.

This embodiment will be described in detail with reference to the accompanying drawings.

<Description of Facsimile Apparatus (FIGS. 8–11)>

Figure 11:
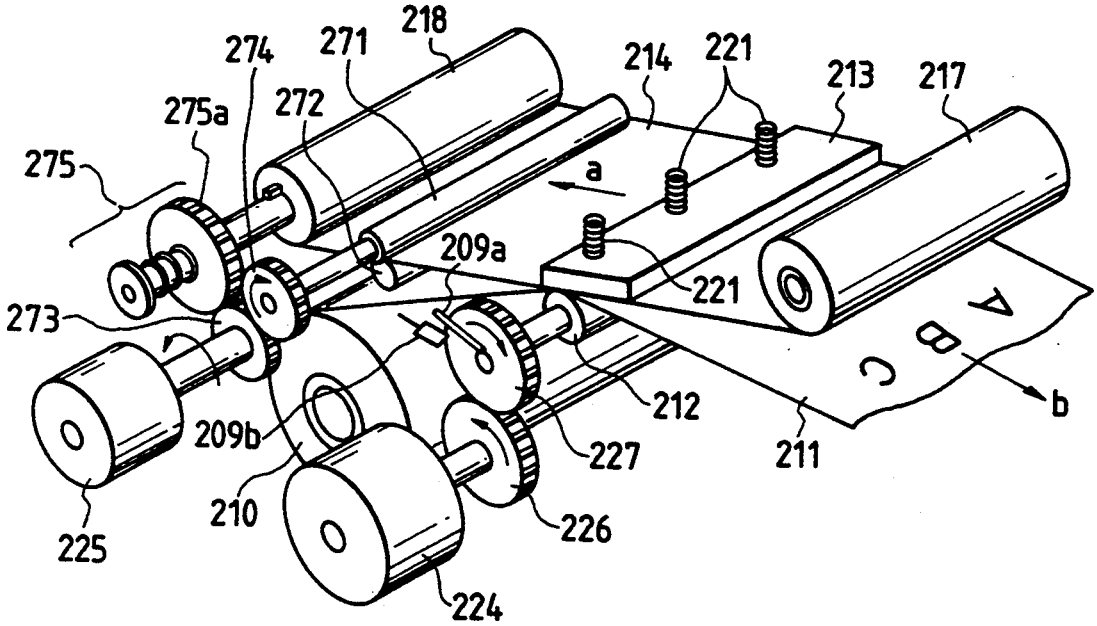
FIG. 11 is a perspective view showing a structure of a feed system for an ink sheet and record paper in the facsimile apparatus shown in FIG. 8.
Figure 8:
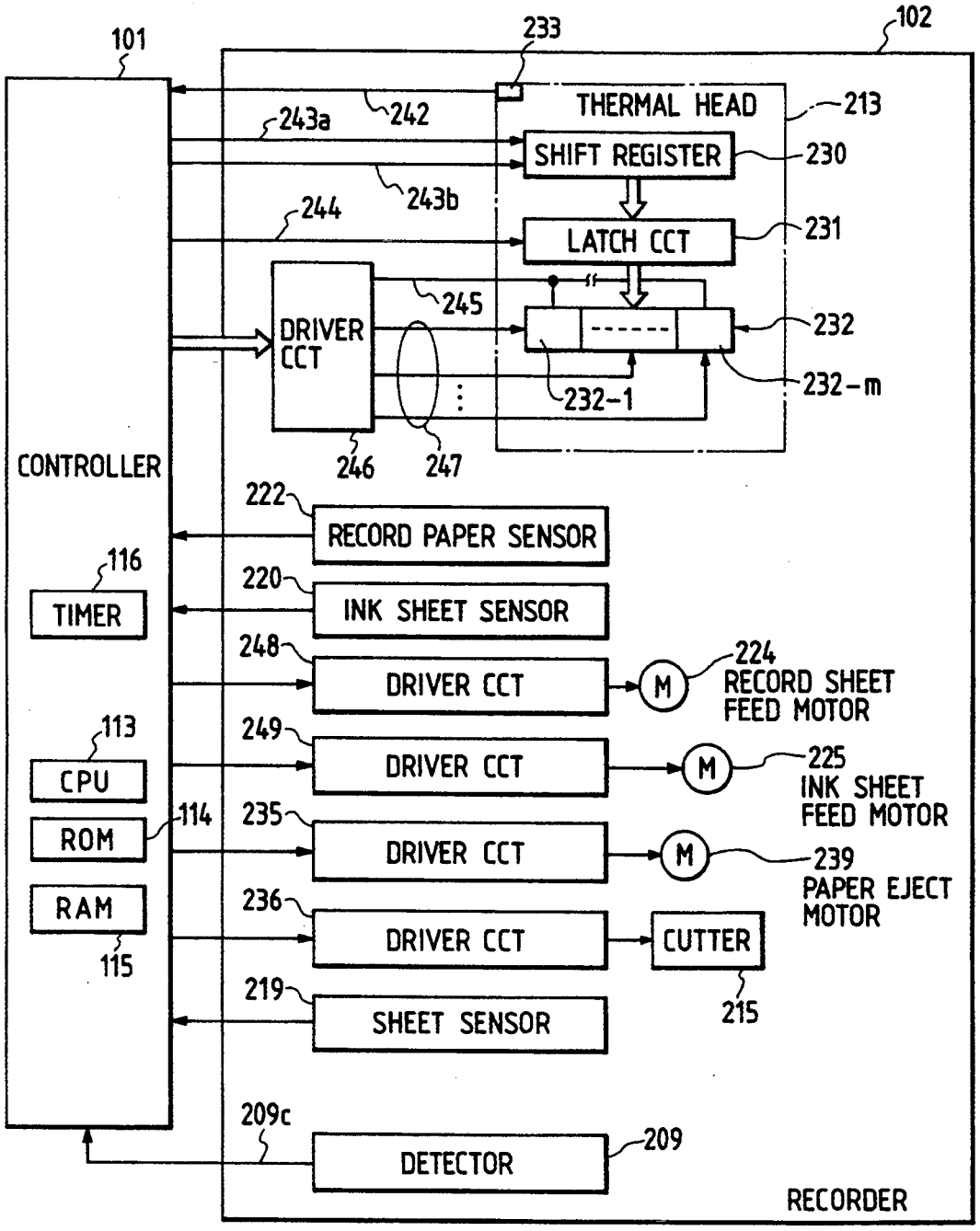
FIG. 8 is a block diagram showing electrical connections between a controller and a record unit in a facsimile apparatus according to another embodiment of the present invention.
Figure 9:
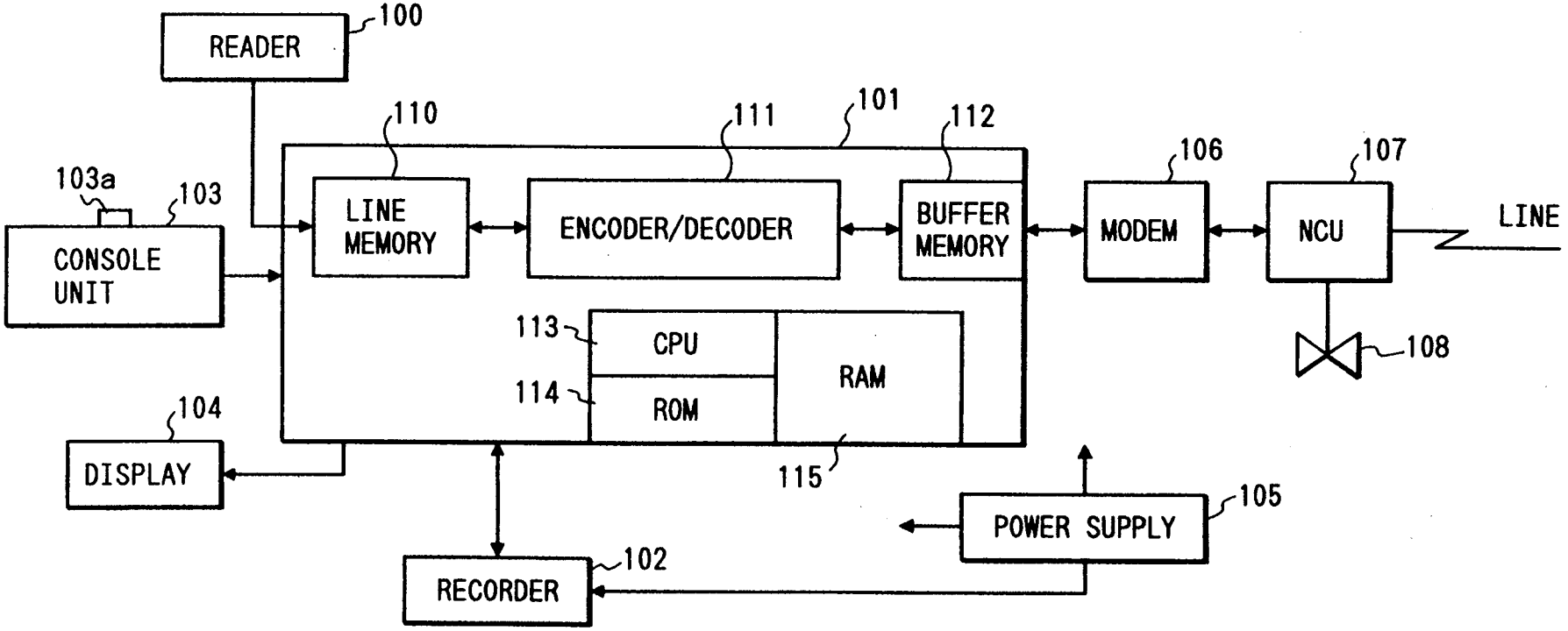
FIG. 9 is a block diagram showing a schematic arrangement of the facsimile apparatus shown in FIG. 8.
Figure 10:
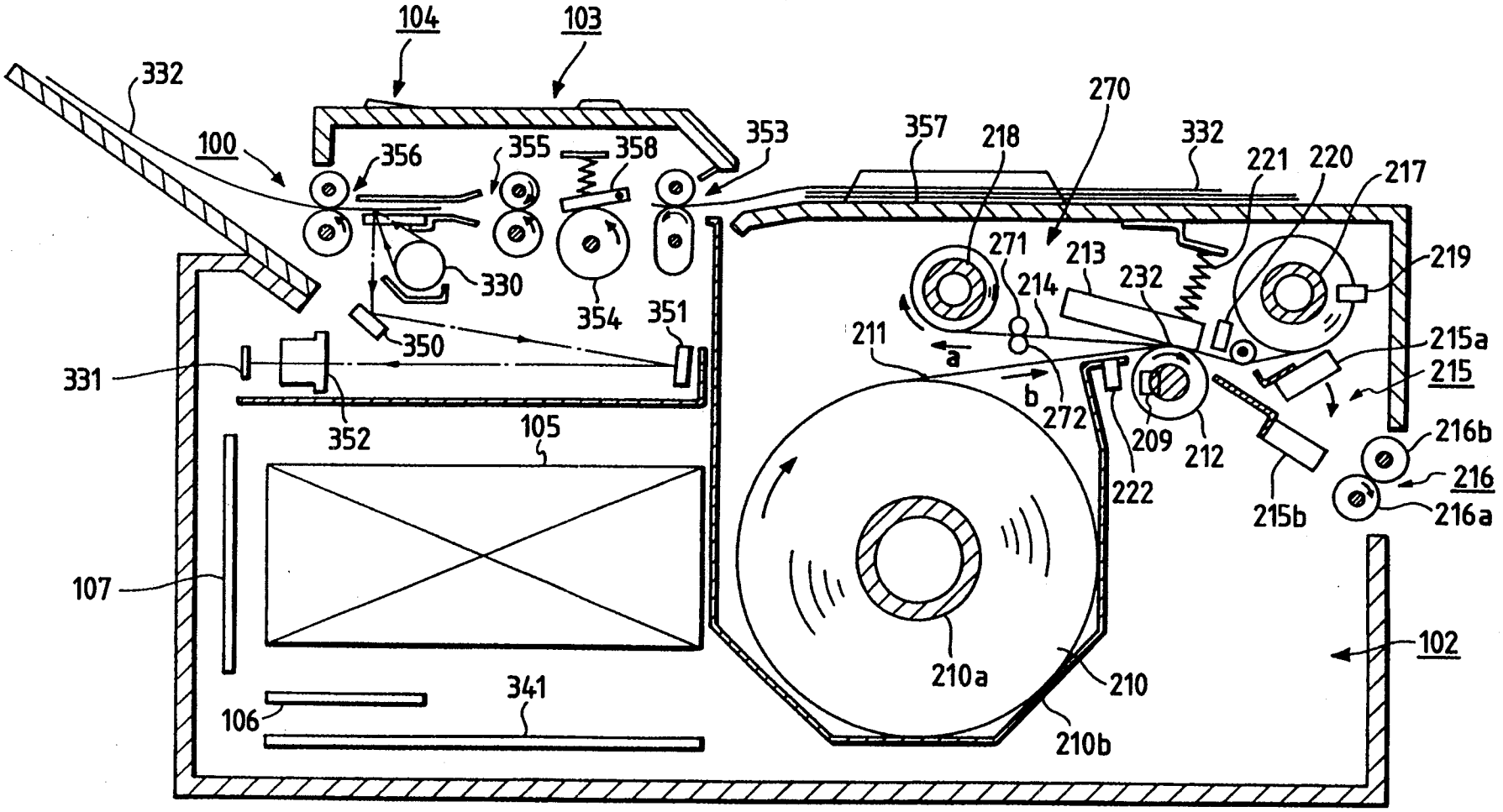
FIG. 10 is a side sectional view showing a mechanism of the facsimile apparatus shown in FIG. 8.
Figure 12:
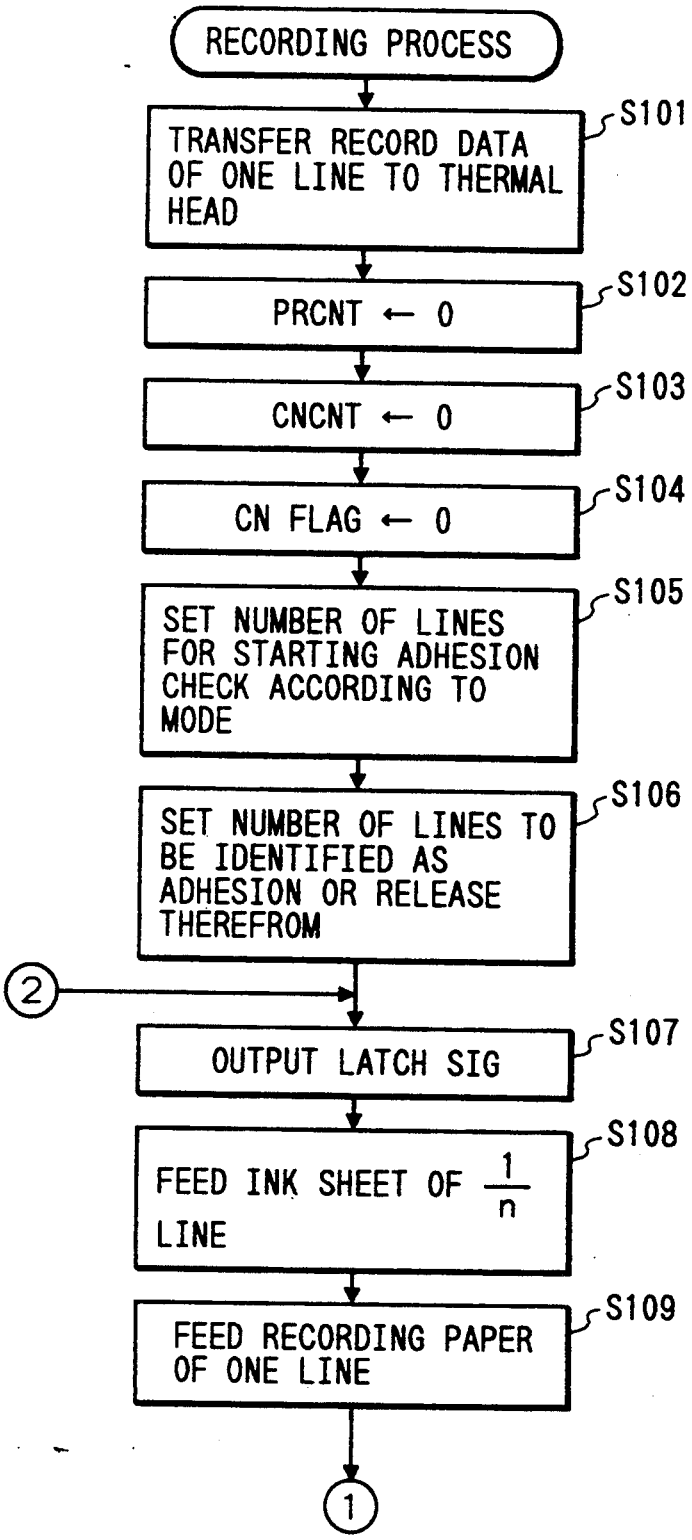
FIGS. 12, 13, 14, 15, 16, 17, 18, and 19 are flow charts showing recording processing of one page in the facsimile apparatus shown in FIG. 8.

FIGS. 8 to 11 show an arrangement in which a heat transfer printer of the present invention is applied to a facsimile apparatus. More specifically, FIG. 8 is a block diagram showing electrical connections between a controller and a recorder in the facsimile apparatus, FIG. 9 is a block diagram showing a schematic arrangement of the facsimile apparatus, FIG. 10 is a side sectional view of the facsimile apparatus, and FIG. 11 is a view showing a feed mechanism of record paper and an ink sheet.

The schematic arrangement of the facsimile apparatus will be described with reference to FIG. 9.

Referring to FIG. 9, a reader 100 photoelectrically reads an original and outputs a read image as a digital image signal to a controller 101. The reader 100 includes an original feed motor and a CCD image sensor. The arrangement of the controller 101 will be described below. A line memory 110 stores image data of each line of image data. The line memory 110 stores image data of one line from the reader 100 in an original transmission mode (facsimile mode) or a copy mode. In an image data reception mode, the line memory 110 stores one-line data of the decoded reception image data. Stored data is output to a recorder 102 to perform image formation. An encoder/decoder 111 encodes transmission image information in accordance with an MH coding scheme and decodes the encoded image data into image data. A buffer memory 112 stores encoded data to be transmitted or received encoded data. The above components of the controller 101 are controlled by a CPU 113 such as a microprocessor. In addition to the CPU 113, the controller 101 includes a ROM 114 for storing control programs and various data, and a RAM 115 for temporarily storing various data as a work area of the CPU 113.

The recorder 102 comprises a thermal line head (having a plurality of heater elements 232 throughout the record width) and performs image recording on record paper in accordance with the heat transfer recording method. The arrangement of the recorder 102 will be described in detail with reference to FIGS. 8 and 10. A console unit 103 has various function keys such as a transmission start key and input keys for inputting a telephone number. A switch 103*a* designates the type of an ink sheet 214 to be used. When the switch 103*a* is set in an ON state, a multiprint ink sheet is mounted. However, when the switch 103*a* is set in an OFF state, a normal ink sheet is mounted. A display 104 is arranged in the console unit 103 to display various functions and a state of the apparatus and the remaining amount of an ink sheet. A power supply 105 supplies power to the entire apparatus. A modem (modulator/demodulator) 106 performs orthogonal conversion of a signal. A network control unit (NCU) 107 controls communication with a line. A telephone set 108 has keys for inputting a telephone number.

The arrangement of the recorder 102 will be described in detail with reference to the side sectional view of FIG. 10, and the enlarged view of the main part in FIG. 11. The same reference numerals as in FIG. 9 denote the same parts in FIGS. 10 and 11.

Referring to FIG. 10, record paper 210 is normal paper. Roll paper 211 is wound around a core 210*a*. The roll paper 210 is rotatably stored in the apparatus so that the record paper 211 can be fed to a record position where a thermal head 213 is located. A roll paper loading unit 210*b* detachably loads the roll paper 210. A platen roller 212 detachably loads the roll paper 210. The platen roller 212 feeds the record paper 211 in a direction indicated by an arrow b. Note that the platen roller 212 urges the ink sheet 214 and the record paper 211 with the heater elements 232 of the thermal head 213.

A detector 209 detects the rotational direction of the platen roller 212. In a normal operation, the platen roller 212 is rotated in the arrowed direction in FIG. 10 and feeds the record paper 211 in the direction indicated by the arrow b. This rotational direction is defined as the forward direction. The detector 209 comprise an arm 209*a* (FIG. 11) interlocked with a rotating shaft of the platen roller 212 and a microswitch 209*b* (FIG. 11) which is turned on/off in synchronism with movement of the arm 209*a*. With this arrangement, when the platen roller 212 is rotated through a predetermined angle $\alpha$ in the reverse direction, the microswitch 209*b* is turned on by the arm 209*a*, thereby detecting that the platen roller 212 is rotated in the reverse direction. In a state wherein the platen roller 212 is rotated in the reverse direction and the microswitch 209*b* is set in an ON state, when the platen roller 212 is rotated through a predetermine angle $\beta$ in the forward direction, the microswitch 209*b* is turned off, so that forward rotation of the platen roller 212 is detected.

The record paper 211 fed to the position of the thermal head 213 upon rotation of the platen roller 212 is subjected to image recording by energization of the heater elements 232 of the thermal head 213. Upon further rotation of the platen roller 212, the record paper 211 is fed in the direction of eject rollers 216 (216*a* and 216*b*). When image recording of one page is completed, the record paper is cut with meshing cutters 215 (215*a* and 215*b*) in units of pages. The cut record paper is ejected outside the apparatus.

The ink sheet 214 is wound around an ink sheet supply roll 217. An ink sheet take-up roll 218 is driven by an ink sheet feed motor (to be described later) and takes up the ink sheet 214 in a direction indicated by an arrow a. The ink sheet supply roll 217 and the ink sheet take-up roll 218 are detachably loaded in an ink sheet loading unit 270 inside the apparatus. A sensor 219 detects the remaining amount of the ink sheet 214 and the feed speed of the ink sheet 214. An ink sheet sensor 220 detects the presence/absence of the ink sheet 214 and the remaining amount of the ink sheet 214 on the basis of a mark formed on the ink sheet 214. A spring 221 urges the thermal head 213 against the platen roller 212 through the record paper 211 and the ink sheet 214. A record paper sensor 222 detects the presence/absence of the record paper 211. The ink sheet 214 is clamped by a capstan roller 271 and a pinch roller 272 and is fed in the direction indicated by the arrow a.

The arrangement of the reader 100 will be described below.

Referring to FIG. 10, a light source 330 illuminates an original 332. Light reflected by the original 332 is input to a CCD sensor 331 through an optical system (mirrors 350 and 351, and a lens 352) and is converted into an electrical signal. The original 332 is fed by feed rollers 353, 354, 355, and 356 driven by an original feed motor (not shown) in synchronism with the read speed of the original 332. A plurality of originals 332 placed on a stacker board 357 are separated one by one by cooperation of the feed roller 354 and a press separation member 358. The separated original 332 is fed to the reader 100.

A control board 341 constitutes the main part of the controller 101. Various control signals are output from the control board 341 to the respective components of the apparatus. The facsimile apparatus also includes a modem board unit 106 and an NCU board unit 107.

FIG. 11 is a view showing a detailed structure of a feed mechanism for the ink sheet 214 and the record paper 211. The same reference numerals as in FIGS. 8, 9, and 10 denote the same parts in FIG. 11.

Referring to FIG. 11, an ink sheet feed motor 225 feeds the ink sheet 214 in the direction indicated by the arrow a. A record paper feed motor 224 feeds the record paper 211 in the direction indicated by the arrow b opposite to the direction indicated by the arrow a. Transmission gears 226 and 227 transmit rotation of the record paper feed motor 224 to the platen roller 212. Transmission gears 273 and 274 transmit rotation of the ink sheet feed motor 225 to the capstan roller 271. This arrangement also includes a slip clutch unit 275.

When the gear ratio of the gear 274 to the gear 275 is set so that the length of the ink sheet 214 taken up by the take-up roll 218 upon rotation of a gear 275*a* is set to be larger than that of the ink sheet fed by the capstan roller 271, a difference between the amount of the ink sheet taken up by the take-up roll 218 and the amount of the ink sheet fed by the capstan roller 271 is absorbed by the slip clutch unit 275. Therefore, variations in feed speed (amount) of the ink sheet 214, which are caused by the variations in take-up diameter of the take-up roll 218 can be suppressed.

The feed force of the capstan roller 271 for the ink sheet 214 is designed to be larger than the feed force of the platen roller 212 for the record paper 211. For this reason, when the ink sheet 214 is adhered to the record paper 211, the record paper 211 is fed together with the ink sheet 214 in the opposite direction. When the record paper 211 is rotated in the reverse direction (i.e., the direction indicated by the arrow a), the platen roller 212 is rotated in the same direction accordingly. When the rotational angle exceeds a predetermined angle, the microswitch 209*b* of the detector 209 is turned on, and reverse rotation of the platen roller 212 is detected. Therefore, adhesion between the ink sheet 214 and record paper 211 can be detected.

When such adhesion occurs, the thermal head 213 is deenergized, and only the record paper 211 is fed. Adhesion between the ink sheet 214 and record paper 211 can be released. Thereafter, the record paper 211 is fed in the direction indicated by the arrow b, and the ink sheet 214 is fed in the direction indicated by the arrow a, thereby turning off the microswitch 209*b* of the detector 209.

FIG. 8 is a block diagram showing electrical connections between the controller 101 and the recorder 102 in the facsimile apparatus of this embodiment. The same reference numerals as in FIGS. 9 to 11 denote the same parts in FIG. 8.

The thermal head 213 comprises a line head, as previously described. The thermal head 213 comprises a shift register 230 for receiving one-line serial record data 243*a* and a shift clock 243*b* from the controller 101, a latch circuit 231 for latching data from the shift register 230 in response to a latch signal 244, and heater elements 232 comprising heater resistors of one line. The heater resistors 232 are driven in m blocks indicated by 232-1 to 232-m. A temperature sensor 233 is mounted on the thermal head 213 to detect the temperature of the thermal head 213. An output signal 242 from the temperature sensor 233 is A/D-converted in the controller 101 and is input to the CPU 113. The CPU 113 detects the temperature of the thermal head 213 and changes the pulse width of a strobe signal 247 or changes the driving voltage to the thermal head 213 in correspondence with the detected temperature, thereby changing an energy applied to the thermal head 213 in accordance with the properties (types) of the ink sheet 214. A count time is set from the CPU 113 to a programmable timer 116. When counting is started, the timer 116 measures the time. The timer 116 outputs an interrupt signal, a time-out signal, and the like to the CPU 113 every designated time.

Note that the type (properties) of the ink sheet 214 is designated by the switch 103*a*. The type and properties of the ink sheet 214 may be automatically detected upon detection of a mark printed on the ink sheet 214. Alternatively, the type (properties) of the ink sheet 214 may be detected by a mark formed on an ink sheet cartridge or a notch or projection formed on the cartridge.

A driver circuit 246 receives a driving signal for the thermal head 213 from the controller 101 and outputs the strobe signal 247 for driving the thermal head 213 in units of blocks. The driver circuit 246 changes a voltage output to a power supply line 245 for supplying a current to the heater elements 232 of the thermal head 213, thereby changing the energy applied to the thermal head 213. A driver circuit 236 drives the cutters 215 and includes a cutter driving motor. An eject motor 239 drives the eject rollers 216. Driver circuits 235, 248, and 249 drive the eject motor 239, the record paper feed motor 224, and the ink sheet feed motor 225, respectively. The eject motor 236 and the ink sheet feed motor 225 may comprise, e.g., stepping motors, but can be replaced with DC motors.

The detector 209 detects the rotational direction of the platen roller 212 to detect adhesion between the ink sheet 214 and record paper 211. More specifically, this detector 209 outputs a signal of "0" level to a signal line 209*c* when the platen roller 212 is rotated in the forward direction (the microswitch 209*b* is in the OFF state) and adhesion between the ink sheet 214 and record paper 211 does not occur. However, when the microswitch 209*b* is set in the ON state and the platen roller 212 is rotated in the reverse direction (i.e., adhesion between the ink sheet 214 and record paper 211 has occurred), the detector 209 outputs a signal of "1" level to the signal line 109*c*.

<Description of Recording Operation (FIGS. 8–19)>

FIGS. 12 to 19 are flow charts showing recording processing of one page in the facsimile apparatus of this embodiment. A control program for executing this processing is stored in the ROM 114 in the controller 101.

This processing is started when record image data of one line is stored in the line memory 110 and a recording operation is ready to start, under the condition that the controller 101 causes the switch 103*a* or the like to detect that the multi-ink sheet 214 is mounted.

When the recording processing is started, in step S101, record data of one line is serially output to the shift register 230 in the thermal head 213. The flow then advances to step S102 to set a counter PRCNT for counting the number of lines of one page to "0". In step S103, every time the record paper is fed for one line, the counter CNCNT for counting the continuous ON/OFF state of the microswitch 209*b* of the detector 209 is set to "0". The flow then advances to step S104 to set to "0" a CN flag representing whether adhesion between the ink sheet 214 and the record paper 211 has occurred.

The flow then advances to step S105 to calculate the number of lines corresponding to a check start record length (mm) (this length is defined by CONST1 (ROM data) and is given as, e.g., 10 mm in this embodiment) in accordance with a currently set record mode (a standard mode, fine mode, or super fine mode). A line count setup process is called to store the calculated number of lines in a counter CCNT1. This subroutine is described in the flow chart of FIG. 15 in detail.

Figure 15:
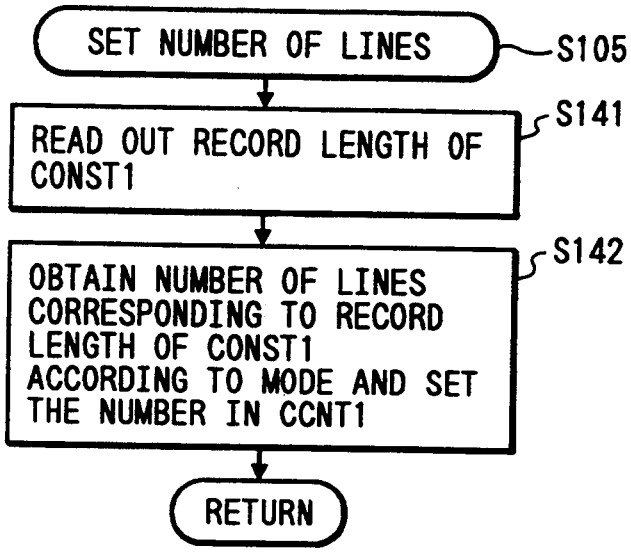

The flow chart in FIG. 15 will be briefly described. The record length (10 mm) defined in CONST1 is read in step S141, and the number of record lines corresponding to this record length is calculated in accordance with the currently set operation mode (e.g., the standard and fine modes) in step S142. The calculated value is stored in the counter CCNT1.

The meaning of the record length (CONST1) until the start of adhesion check will be described below. Upon recording of one page, the record paper 211 of one page is cut, and the record paper 211 is returned to the record position of the thermal head 213. In this case, the platen roller 212 is kept stopped upon reverse rotation. For this reason, when recording of one page is started, recording of a predetermined length (10 mm in this case) stored in the CONST1 is completed, and the platen roller 212 is rotated through a predetermined angle in the forward direction. In this case, the microswitch 209*b* for detecting adhesion between the ink sheet 214 and the record paper 211 is turned off. In this manner, after the microswitch 209*b* is turned off, processing for detecting whether adhesion between ink sheet 214 and the record paper 211 has occurred is started.

In step S106, the number of lines corresponding to a record length CONST2 (ROM data) (e.g., 3 mm in this embodiment) which in turn corresponds to a record length assumed to be subjected to adhesion between the ink sheet 214 and the record paper 211 or to release of adhesion between the ink sheet 214 and the record paper 211 after such adhesion is calculated in accordance with the currently set mode (the standard, fine, or super fine mode). The subroutine for storing the calculated number of lines in a counter CCNT2 is called. Processing of this subroutine is described in the flow chart of FIG. 16 in detail.

Figure 16:
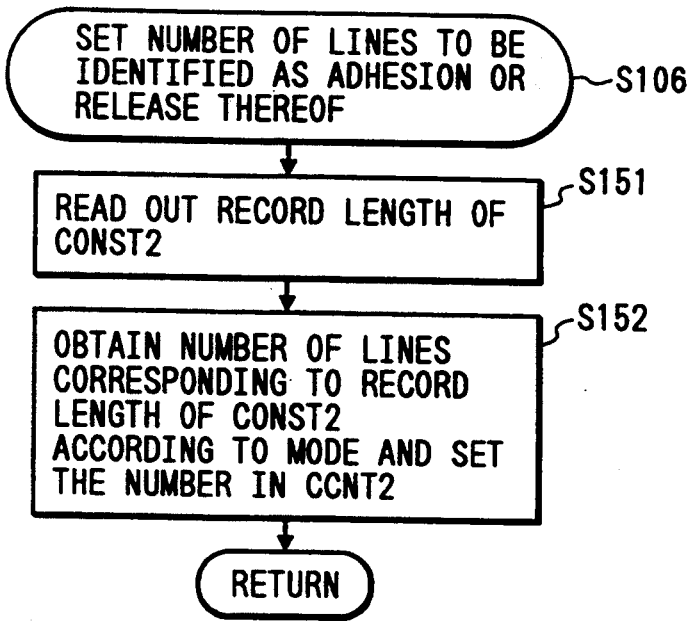

In the flow chart of FIG. 16, the record length (3 mm in this case) stored in the CONST2 is read out in step S151. In step S152, the number of lines corresponding to this record length is calculated in accordance with the currently set record mode. The calculated value is stored in the CCNT2.

Referring back to FIG. 12, the flow advances to step S107, and the latch signal 244 is output to store record data of one line in the latch circuit 231 in the thermal head 213. In step S108, the ink sheet feed motor 225 is driven to feed the ink sheet 214 by 1/n lines (i.e., 1/n times the feed length of the record paper 211) in the direction indicated by the arrow a in FIG. 11. In step S109, the record paper feed motor 224 is driven to feed the record paper 211 for one line in the direction indicated by the arrow b in FIG. 11. The length of one line is set to be about (1/15.4) mm in the facsimile apparatus of this embodiment. The feed amounts of the record paper 211 and the ink sheet 214 can be changed by changing excitation pulse counts for the record paper feed motor 224 and the ink sheet feed motor 225.

Figure 13:
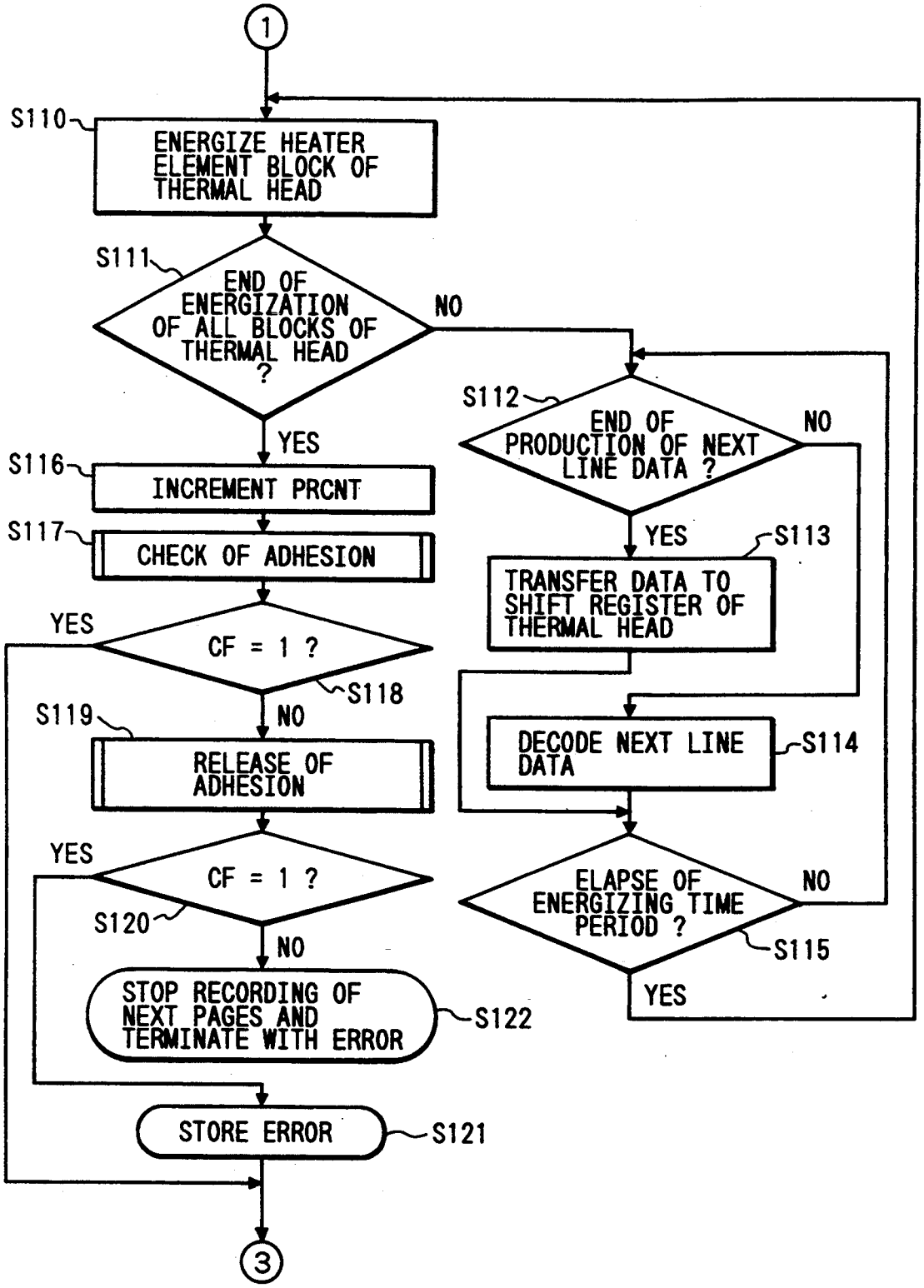

The flow then advances to step S110 in FIG. 13. One of the blocks of the heater elements 232 of the thermal head 213 is energized to perform image recording. In step S111, it is determined whether all blocks (four blocks) of the thermal head 213 are energized. If energization of all the blocks of the thermal head 213 is not yet completed in step S111, the flow advances to step S112. However, if energization of all the blocks of the thermal head 213 is completed, the flow advances to step S116.

It is determined in step S112 whether record data of the next time is generated. If NO in step S112, the flow advances to step S114 to decode the data of the next line. Data generation is executed, and the flow advances to step S115. However, when generation of record data of the next line is completed in step S112, the flow advances to step S113. Serial record data **243*a* is output to the shift register 230 in synchronism with the shift clock 243*b*, and the record data of the next line is transferred to the thermal head 213. It is determined in step S115 whether the energization time (about 600 μs) for one block of the thermal head 213 has elapsed. If NO in step S115, the flow returns to step S112. Otherwise, the flow returns to step S110, and the next block is energized. In this embodiment, the heater resistors 232 of the thermal head 213** are divided into four blocks, and a period required for recording of one line is about 2.5 ms (600 ηs×4).

In step S111, when all the blocks are energized and image recording of one line is completed, the flow advances to step S116. Since recording of one line has been completed, a counter PRCNT is incremented by one. The flow advances to step S117 to call a subroutine for checking whether the ink sheet 214 and the record paper 211 are adhered to each other. Processing of this subroutine is shown in the flow chart of FIG. 17 in detail.

Figure 17:
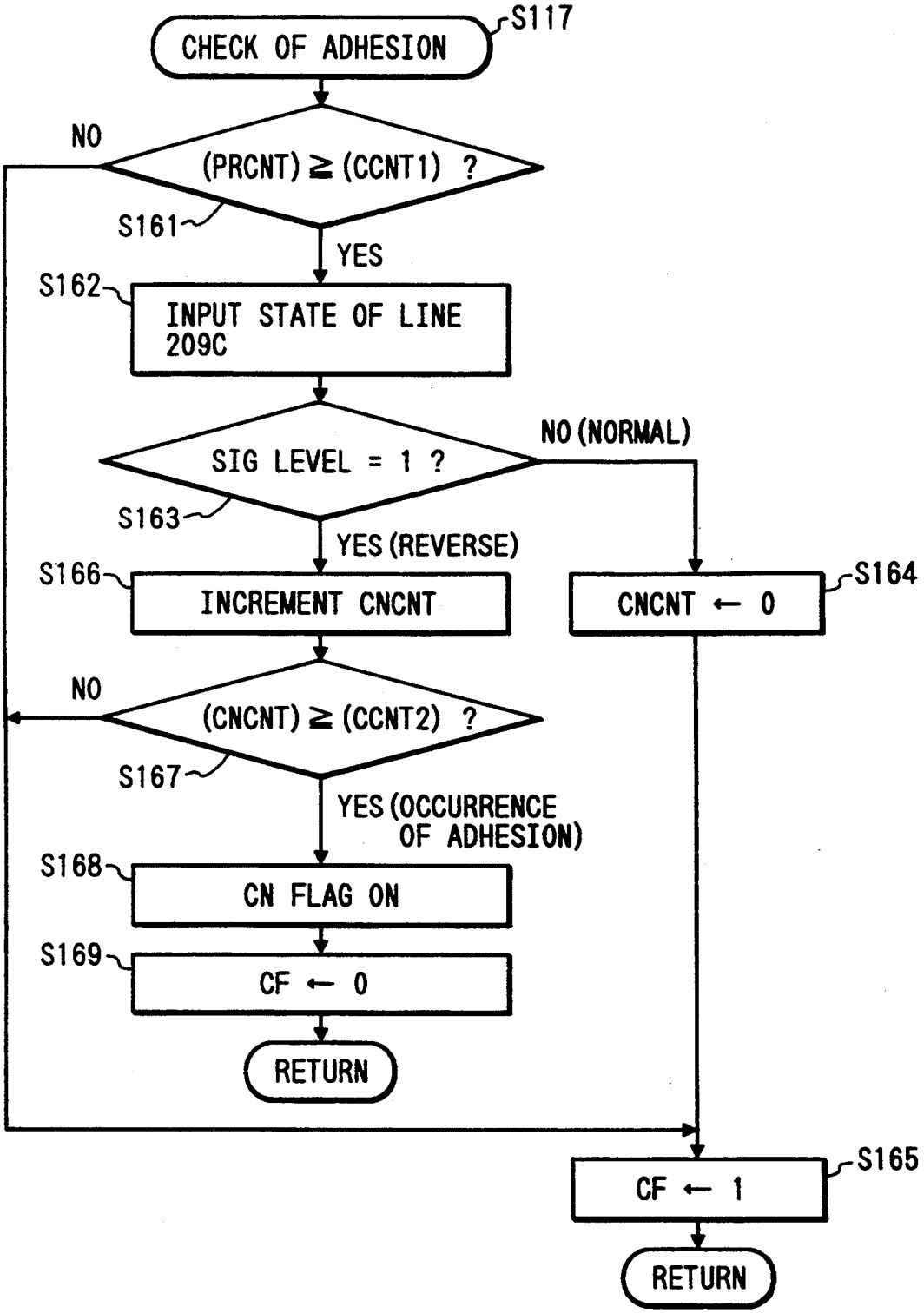

This processing of check of adhesion will be described in detail with reference to FIG. 17.

It is determined in step S161 whether the number of recorded lines (i.e., the PRCNT value) is larger than the number of lines for starting the check of adhesion. If NO in step S161, since the number of recorded lines is less than the number of lines for starting the check of adhesion (i.e., since a state for checking adhesion is not set), the flow advances to step S165 to set a carry flag to CF=1, and the flow returns to the main routine.

When the state for checking adhesion is set, the flow advances to step S162 to input the state of the signal line **209*c* connected to the output of the detector 209. It is then determined in step S163 whether the microswitch 209*b* is ON/OFF. If the signal level of the signal line 209*c* is set to be "1", i.e., when rotation of the platen roller 212 is reversed, the flow advances to step S166. However, when the microswitch 209*b* is set in an OFF state (the value of the signal line 209*c* is set to be "0"), i.e., when the platen roller 212 is rotated in the forward direction, the flow advances to step S164**. In this case, adhesion has not occurred. The counter CNCNT is set to be "0".

In step S166, since there is a possibility of adhesion between the ink sheet 214 to the record paper 211, the counter CNCNT is incremented by one. The flow then advances to step S167 to compare this CNCNT value with a CCNT2 value representing the number of lines for check of adhesion. Since the CCNT2 stores the number of lines assumed to be subjected to adhesion, when the value of the counter CNCNT exceeds the CCNT2 value, adhesion between the ink sheet 214 and the record paper 211 is determined. The flow advances to step S168 and the CN flag is set in an ON state. The carry flag CF is set to be "0" in step S169, and the flow returns to the main routine. Note that if a possibility of adhesion is zero in accordance with the value of the counter CNCNT, the flow advances from step S167 to step S165, and the carry flag CF is set to be "1". The flow then returns to the main routine.

Referring back to the flow chart of FIG. 13, it is determined in step S118 whether a carry flag CF is set to be "0", i.e., adhesion between the ink sheet 214 and the record paper 211 has occurred. If the carry flag CF is "0", i.e., if YES in step S118, the flow advances to step S119. Otherwise, the flow advances to step S123. Upon detection of adhesion, a processing routine for releasing this adhesion is called in step S119. This routine is shown in the flow charts of FIGS. 18 and 19.

Figure 18:
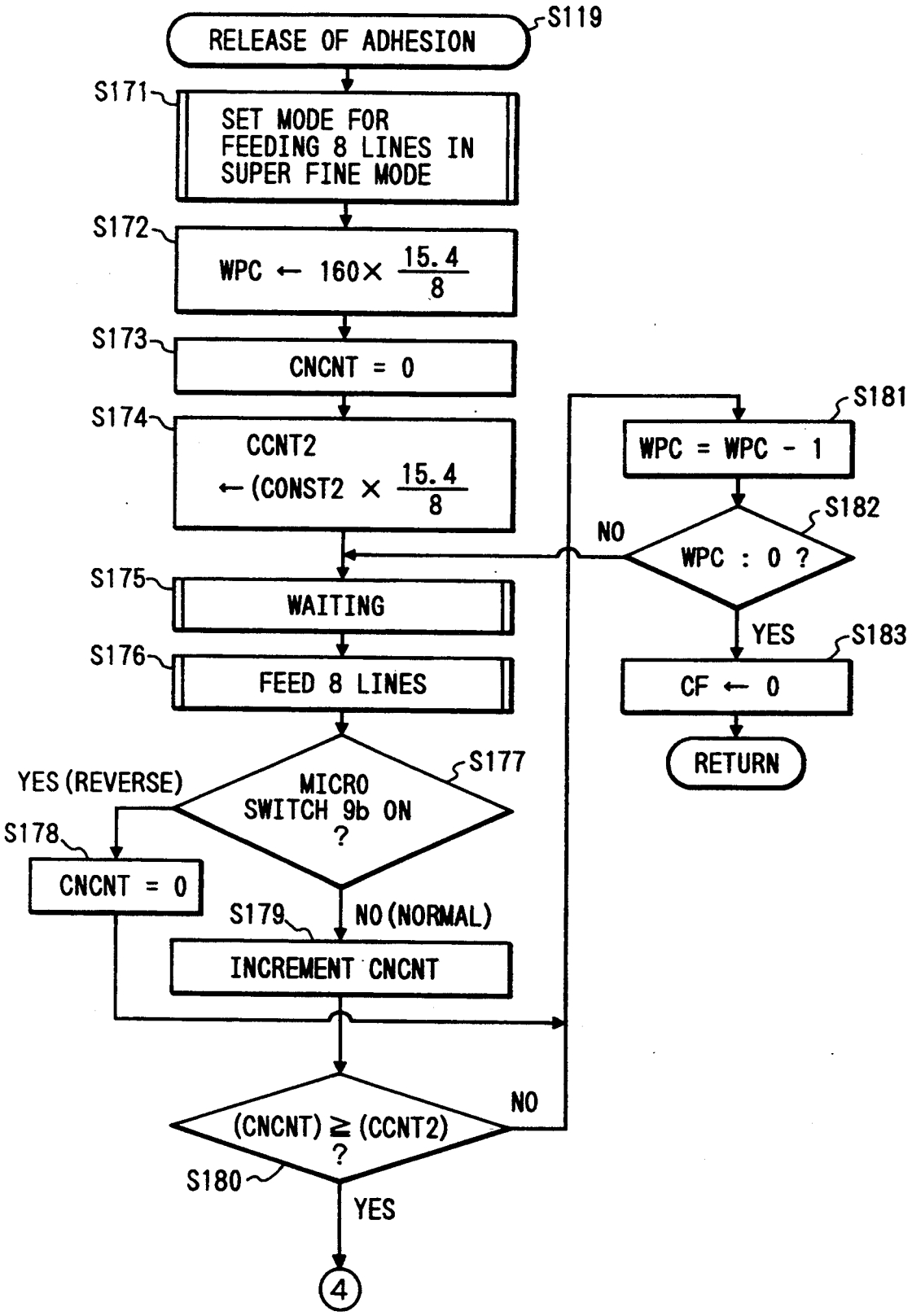
Figure 19:
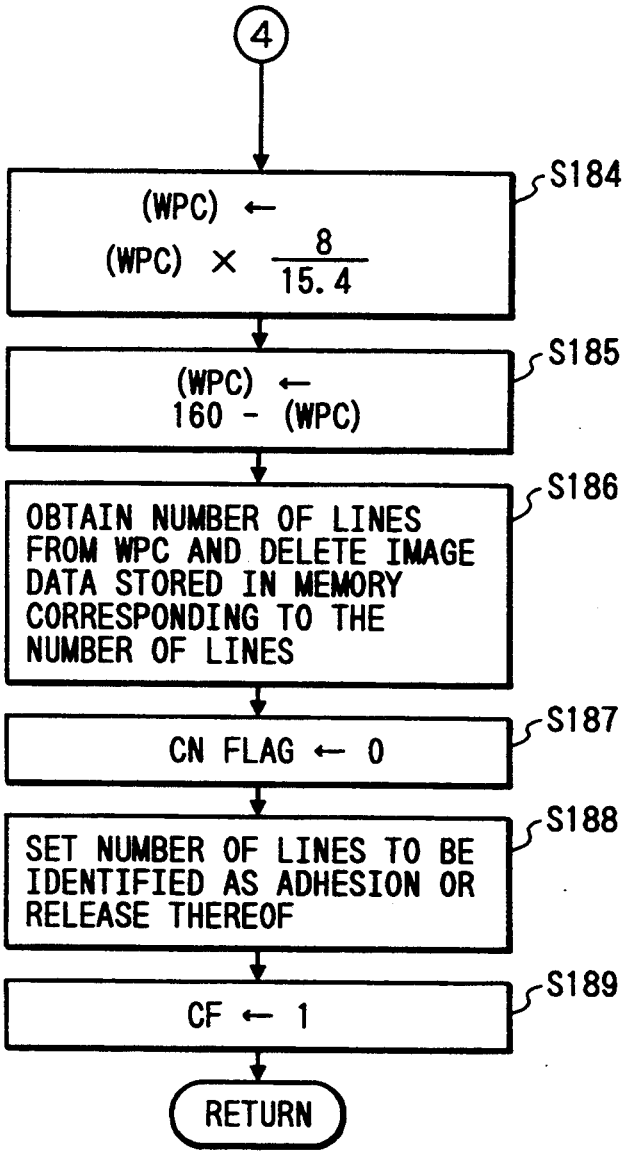

Processing of releasing the adhesion between the record paper 211 and the ink sheet 214 in the facsimile apparatus of this embodiment will be described in detail with reference to the flow charts of FIGS. 18 and 19.

In step S171, a mode for feeding eight lines in a super fine mode is set in response to a trigger command of step S176. The flow advances to step S172 to feed the record paper 211 by a maximum of 16 cm in the direction indicated by the arrow b in FIG. 11. At the same time, the ink sheet 214 is fed by (16/n) cm in the direction indicated by the arrow a in FIG. 11. In order to check release of adhesion, a trigger command count corresponding to the corresponding length is set in a counter WPC. That is, a value of 308 (=160×(1.54/8)) is set in the counter WPC. The flow then advances to step S173 to set to "0" the counter CNCNT which counts the continuous OFF state of the microswitch **209*b*. A trigger command count corresponding to feeding the record paper 211 for a record length (3 mm) stored in the counter CONST2 is set in the counter CCNT2 in step S174**. Therefore, CCNT2=CONST2×(15.4/8).

The flow advances to step S175, and the apparatus waits until neither the record paper feed motor 224 nor the ink sheet feed motor 225 are busy. When each motor is set in an operative state, the flow advances to step S176 to output a trigger to feed the record paper 211 and the ink sheet 214. Each of the record paper 211 and the ink sheet 214 is fed by eight lines in the corresponding direction in the super fine mode. The flow then advances to step S177 to determine whether the microswitch **209*b* of the detector 209 is ON. If YES in step S177 (i.e., the platen roller 212 is kept rotated in the reverse direction), the flow advances to step S178 to clear the counter CNCNT to "0". If the microswitch 209*b* is set in the OFF state, i.e., when the platen roller 212** is kept rotated in the forward direction, the flow advances to step S179 to increment the counter CNCNT by one. It is then determined in step S180 whether the value of this counter CNCNT exceeds the trigger command count (i.e., the CCNT2 value) for feeding the record paper 211 by a distance corresponding to the CONST2 value (3 mm).

When the CNCNT value exceeds the trigger command count (CCNT2) for feeding the record paper 211 by 3 mm (CONST2), the flow advances to step S184. Otherwise, the flow advances to step S181 to decrement the value of the counter WPC by one. It is determined in step S182 whether the value of the counter WPC is set to be "0". If YES in step S182, the flow advances to step S183. Otherwise, the flow returns to step S175. An operation in step S183 indicates that release of adhesion between the ink sheet 214 and the record paper 211 is not obtained even if the record paper feed motor 224 is driven to feed the record paper 211 by 16 cm in the direction indicated by the arrow b. In this case, the carry flag CF is set to be "0", and the flow returns to the main routine.

On the other hand, when the CNCNT value exceeds the trigger command count (CCNT2) for feeding the record paper 211 by 3 mm (CONST2) in step S180, the flow advances to step S184. In this case, the ink sheet 214 is released from the record paper 211 within the feed distance of 16 cm of the record paper 211. A feed length of the record paper 211 in steps S184 and S185 is obtained. More specifically, the WPC value is multiplied with (8/15.4) to obtain a product, and 160 is subtracted from this product to obtain the feed length of the record paper 211. The flow advances to step S186, and the number of lines fed from the WPC value (mm) in accordance with the standard, fine, or super fine mode is obtained. The image data stored in the buffer memory 112 is deleted by this number of lines. A record pointer is incremented by this number of lines. The flow advances to step S187. Since adhesion between the ink sheet 214 and the record paper 211 is released, the CN flag is set to be "0". The flow advances to step S188 to call the routine for setting the number of lines for release of adhesion as in step S106. The flow advances to step S189 to set the carry flag (CF) to "1". The flow then returns to the main routine.

Referring back to the flow chart of FIG. 13, it is determined in step S120 whether the carry flag (CF) is set to be "1", i.e., whether adhesion between the record paper 211 and the ink sheet 214 is released. If the carry flag (CF) is set to be "1", the flow advances to step S121 to store an adhesion error, and the flow advances to step S123. However, if the carry flag (CF) is kept set to be "0", since adhesion between the ink sheet 214 and the record paper 211 is not yet released, the flow advances to step S122 to interrupt of recording from the next page. In this case, the flow is ended with an error.

Figure 14:
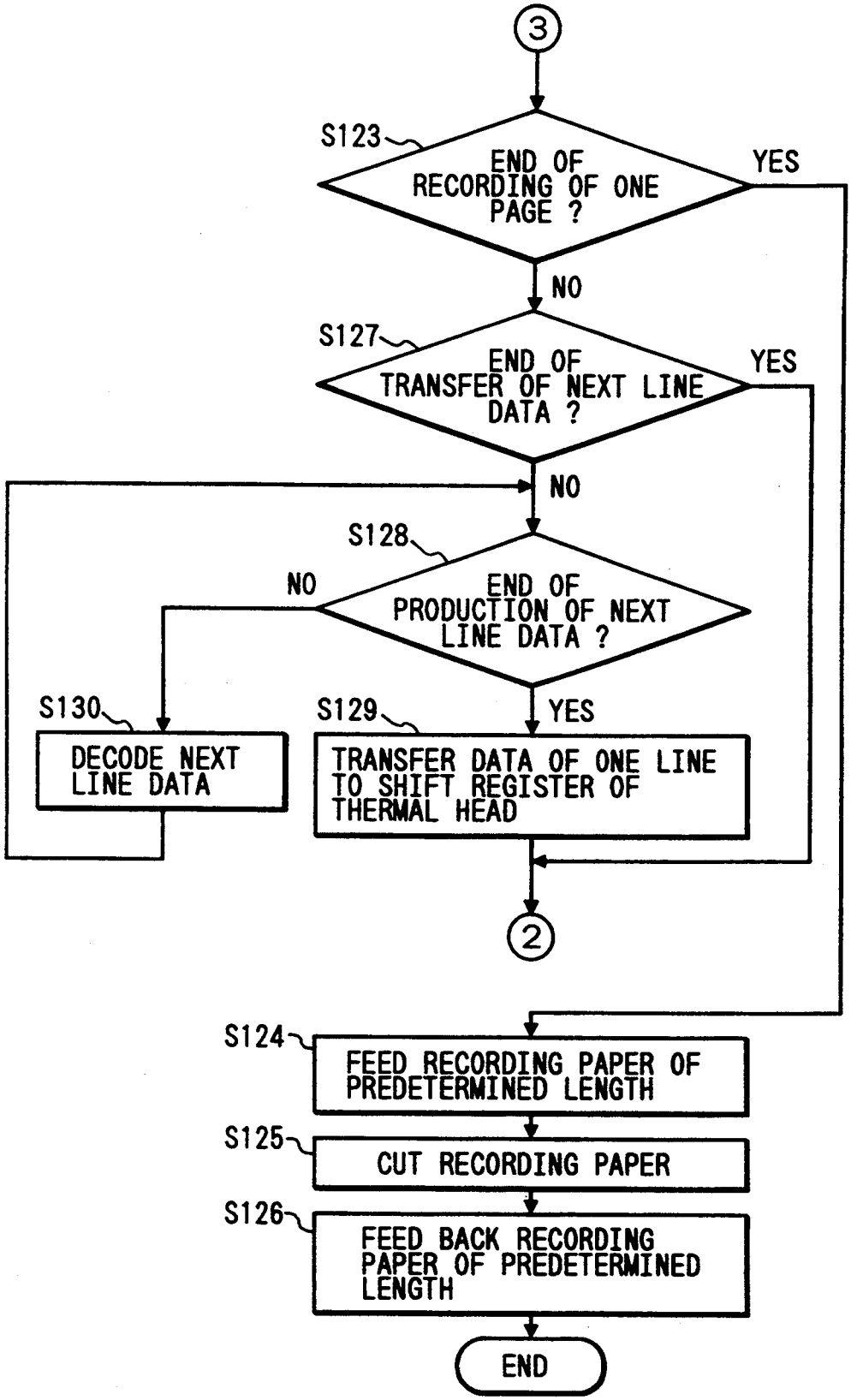

When no adhesion is detected or release of adhesion is detected, the flow advances to step S123 in FIG. 14 to determine whether recording of one page is ended. If YES in step S123, the flow advances to step S124. Otherwise, the flow advances to step S127. In step S124, the record paper 211 of the predetermined length is fed toward the eject rollers 216a and 216*b*. The movable cutter 215*a* is driven with respect to the stationary cutter 215*b* and is engaged therewith to cut the record paper 211 of one page in step S125. The record paper feed motor 224 is driven in the reverse direction to return the record paper 211 by a length corresponding to the distance between the thermal head 213 and the cutters 215 in step S126, thereby cuing the record position.

If recording of one page is not ended in step S123, the flow advances to step S127 to determine whether data of the next line is transferred to the thermal head 213. If data transfer is ended, the flow returns to step S107. However, when data transfer is not ended, the flow advances to step S128 to determine whether decoding of data of the next line is ended. If YES in step S128, the flow advances to step S129 to serially transfer the data of the next line to the shift register 230 in the thermal head 213. If decoding of the data of the next line is not ended in step S128, the flow advances to step S130 to decode the data of the next line, and the flow returns to step S128.

<Description of Principle of Recording (FIG. 20)>

Figure 20:
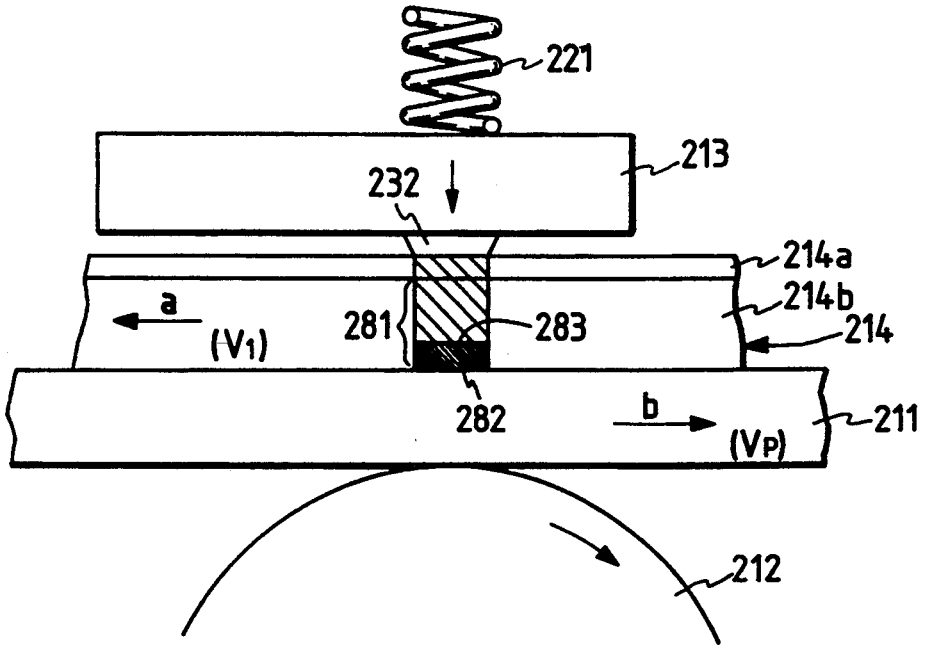
FIG. 20 is a view for explaining the principle of recording in the facsimile apparatus shown in FIG. 8.

FIG. 20 is a view showing an image recording state in which the feed directions of the record paper 211 and the ink sheet 214 of this embodiment are opposite to each other.

As shown in FIG. 20, the record paper 211 and the ink sheet 214 are clamped between the platen roller 212 and the thermal head 213, and the thermal head 213 is urged by the spring 221 against the platen roller 212 at a predetermined pressure. The record paper 211 is fed at a speed Vp in a direction indicated by an arrow b in FIG. 20 upon rotation of the platen roller 212. On the other hand, the ink sheet 214 is fed at a speed $V_I$ in a direction indicated by an arrow a in FIG. 20 upon rotation of the ink sheet feed motor 225.

When the power is supplied from the power supply 105 to the heater resistors 232 of the thermal head 213, a hatched portion 281 of the ink sheet 214 is heated. The ink sheet 214 comprises a base film 214a and an ink layer 214*b*. The ink of an ink layer 281 heated upon energization of the heater resistors 232 is melted, and a portion 282 of the ink layer 281 is transferred to the record paper 211. The transferred ink layer portion 282 corresponds to almost 1/n the ink layer 281. During ink transfer, a shear force for the ink must be generated at a boundary 283 of the ink layer 214*b*, and only the ink layer portion 282 must be transferred to the record paper 211. If the relative speed between the ink sheet 214 and the record paper 211 is increased, an ink layer to be transferred can be properly released from the ink sheet 214.

<Description of Ink Sheet (FIG. 21)>

Figure 21:
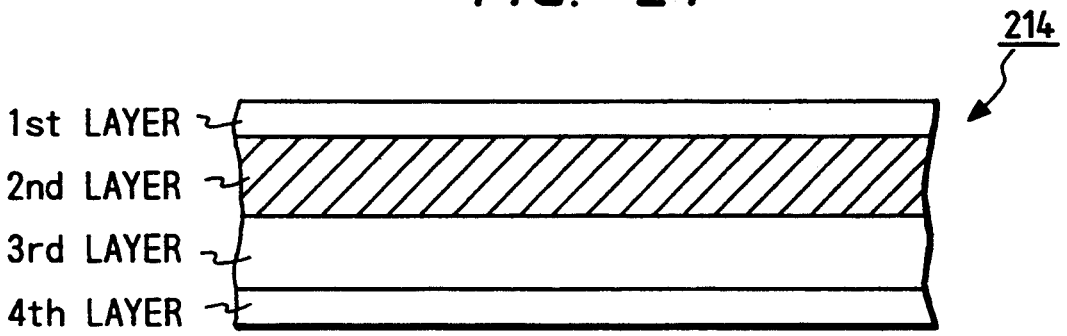
FIG. 21 is a sectional view of an ink sheet used in the embodiment shown in FIG. 8.

FIG. 21 is a sectional view of the ink sheet 214 used in the multiprint operation. An ink sheet consisting of four layers will be exemplified.

The second layer is a base film serving as a support of the ink sheet 214. In the multiprint operation, since heat energy is repeatedly applied to each portion, the base film preferably consists of an aromatic polyamide film or condenser paper having a high heat resistance. However, a conventional polyester film can also be used. The thickness of the base film is preferably small in terms of print quality because it serves as a medium. The thickness of the base film preferably falls within the range of 3 to 8 μm in favor of mechanical strength.

The third layer is an ink layer which contains an amount of ink enough to allow transfer recording on the record paper (record sheet) n times. The ink components such as a resin such as EVA serving as an adhesive, a carbon black or nigrosine dye serving as a coloring agent, and carnauba wax or paraffine wax serving as a binder as major components are mixed to endure recording at the same position n times. The ink coating amount preferably falls within the range of 4 to 8 g/m$^2$. However, the ink coating amount can be arbitrarily selected in accordance with the sensitivity and concentration of the ink components used.

The fourth layer is a top coating layer formed to prevent the ink of the third layer from being pressure-transferred to a non-print portion of the record paper. The fourth layer consists of a transparent wax. The layer to be pressure-transferred to the record paper is the fourth layer to prevent scumming of the record paper. The first layer is a heat-resistant coat layer for protecting the base film as the second layer from heat from the thermal head 213. This layer is suitable for the multiprint in which a maximum of heat energy of n lines is applied to the same position (if black data continue). However, the first layer may be omitted in accordance with application purposes. The first layer is also effective for a base film (e.g., a polyester film) having a relatively low heat resistance.

The structure of the ink sheet 214 is not limited to the one described in this embodiment. For example, an ink sheet may consist of a base layer and a porous ink retaining layer formed on one surface of the base layer and containing an ink, or an ink sheet may be arranged such that a heat-resistant ink layer having a fine porous net-like structure is formed on a base film, and an ink is contained in this ink layer.

The base film may consist of a film (e.g., polyamide, triacetylcellulose, nylon, polyvinyl chloride, or polypropylene) or paper. In addition, the heat-resistant coat layer need not be formed. The material of the heat-resistant coat layer may be silicone resin, epoxy resin, or melamine resin.

A heating scheme used in the heat transfer printer is not limited to a thermal head scheme used in the thermal head described above, but can be replaced with an energization or laser transfer scheme.

In this embodiment, the feed directions of the record paper 211 and the ink sheet 214 during recording are opposite to each other. However, the feed direction of the record paper 211 may be the same as that of the ink sheet 214.

In addition, the record medium is not limited to record paper. A material to which an ink can be transferred, such as a cloth or plastic sheet, may be used. An ink sheet loading mechanism is not limited to a roll mechanism. For example, a so-called ink sheet cassette type in which an ink sheet is incorporated in a case detachable from the recording apparatus and the case itself is detachably arranged in the recording apparatus can be used.

In each embodiment described above, a full-line printing scheme is exemplified. However, the present invention is not limited to this, but is applicable to a so-called serial heat transfer recording apparatus. In each embodiment described above, the multiprint ink sheet is exemplified, but the present invention is also applicable to normal heat transfer recording using a one-time ink sheet.

In each embodiment described above, the facsimile apparatus is exemplified as the heat transfer recording apparatus. However, the present invention is not limited to the heat transfer recording apparatus, but is applicable to a wordprocessor, a typewriter, or a copying machine, as a matter of course.

In the above embodiment, upon detection of adhesion between the ink sheet 214 and the record paper 211, when this adhesion is released during feeding of the record paper 211 by 16 cm, page information subjected to the adhesion can be continuously received. However, this page information may be regarded as an error, and reception may be started from the next page. This arrangement is effective when the buffer memory 112 for storing the reception image data may overflow during feeding of the record paper 211 by 16 cm.

In the above embodiment, adhesion between the record paper 211 and the ink sheet 214 is not detected until recording of 1 cm (10 mm) from the start of recording of one page is completed. In the above embodiment, in order to determine the occurrence of adhesion or to determine release in an adhesion state, the continuous ON/OFF state of the microswitch **209*b* occurs during feeding of the record paper 211** by 3 mm. However, this length is not limited to 3 mm, but can be replaced with another value.

Figure 22:
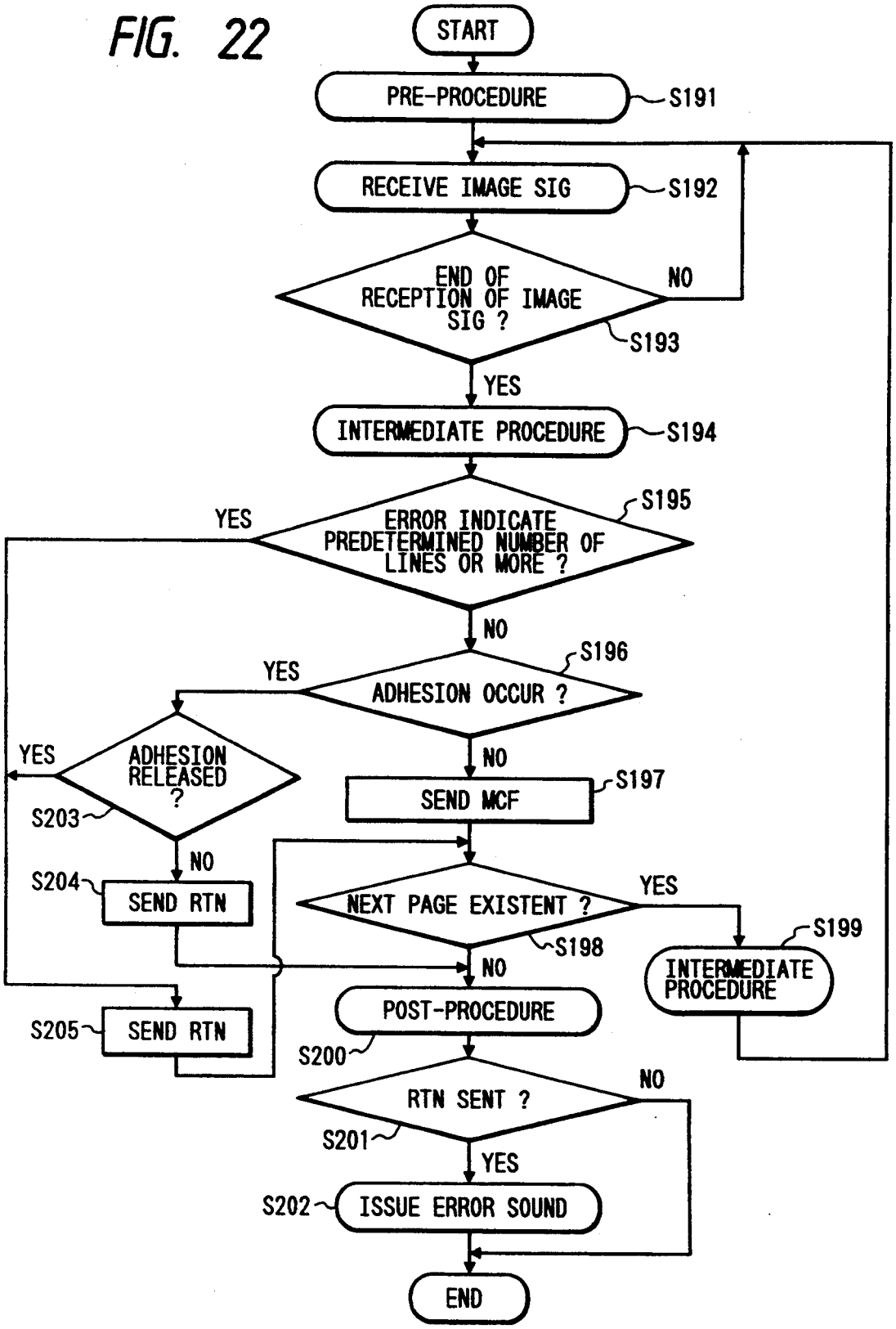
FIG. 22 is a flow chart showing reception processing of the facsimile apparatus shown in FIG. 8.
Figure 23:
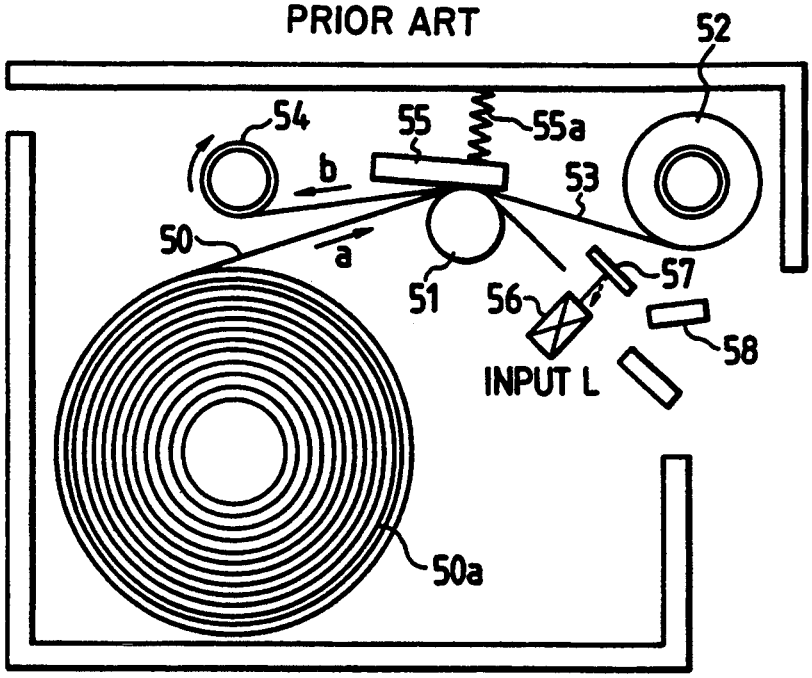
FIG. 23 PRIOR ART
FIG. 23 is a sectional view for explaining a conventional facsimile apparatus.
Figure 24:
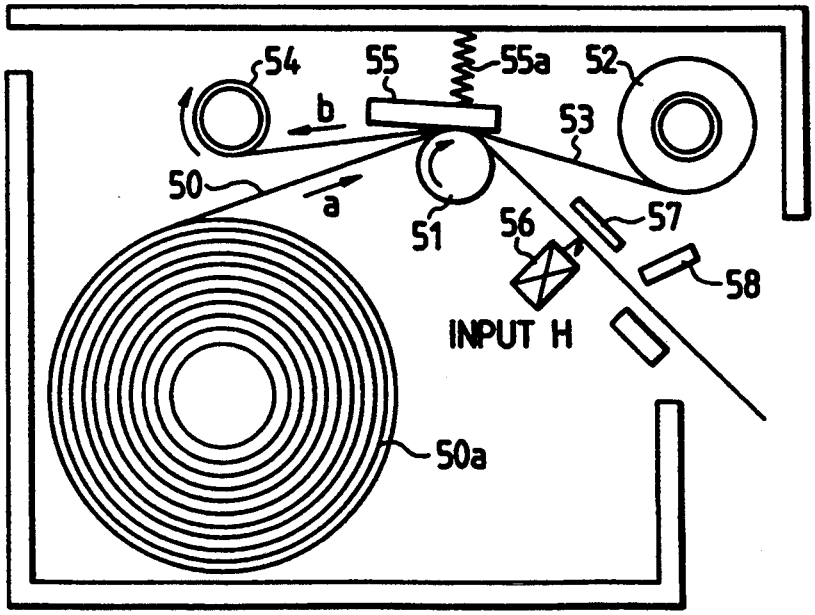
FIG. 24 PRIOR ART
FIG. 24 is a sectional view for explaining the conventional facsimile apparatus in FIG. 23.

FIG. 22 is a flow chart showing reception recording in the facsimile apparatus of this embodiment. A signal RTN is sent for page information subjected to adhesion. Once the signal RNT is sent, an error sound is produced.

Referring to FIG. 22, a pre-procedure is performed in step S191, and an image signal is received in step S192. It is determined in step S193 whether reception of the image signal is ended. If YES in step S193, the flow advances to step S194 to perform an intermediate procedure.

The flow advances to step S195 to determine whether an error indicating a predetermined number of lines or more has occurred. If an error indicating the predetermined number of lines or more is determined to have occurred, the flow advances to step S205 to output a signal RTN. However, if an error indicating the predetermined number of lines or more is determined not to have occurred, the flow advances to step S196 to detect whether adhesion between the ink sheet 214 and the record paper 211 has occurred. If NO in step S196, the flow advances to step S197. Otherwise, the flow advances to step S203.

A signal MCF is sent out in step S197, and the flow advances to step S198 to determine whether data of the next page is existent. If YES in step S198, the flow advances to step S199 to perform an intermediate procedure, and the flow returns to step S191. However, if NO in step S198, the flow advances to step S200 to perform a post-procedure. The flow then advances to step 201 to determine whether a signal RTN is sent out upon the current reception of the data. If the signal RTN is sent out, the flow advances to step S202 to produce or issue an error sound. Otherwise, the processing is ended.

On the other hand, when adhesion is determined in step S196, the flow advances to step S203 to determine whether this adhesion is released during feeding of the record paper 211 by 16 cm. If the adhesion is released during feeding of the record paper 211 by 16 cm, the flow advances to step S205 to output a signal RTN. However, if NO in step S203, the flow advances to step S204 to output a signal RTN. The flow then advances to step S198.

If an adhesion between the record paper 211 and the ink sheet 214 occurs and feeding of the record paper 211 by 16 cm cannot release this adhesion, a message saying "Please Check Ink Sheet" may be displayed on the display 104 until the operator depresses any one of the keys.

Note that the present invention may be applied to a system having a plurality of equipments or an apparatus having only one equipment. The present invention is also achieved by supplying a program for executing the present invention to a system or apparatus.

In the embodiment described above, when adhesion between the ink sheet 214 and the record paper 211 occurs, it can be detected and the corresponding page information can be processed as an error. This error information can be transmitted to a mating transmitter.

In the thermal recording apparatus, adhesion between the record paper and the ink sheet can be automatically released, and recording from the next page can be normally continued. Therefore, a decisive trouble such as disconnection of the ink sheet, caused by adhesion between the ink sheet 214 and the record paper 211 can be prevented.

Upon detection of adhesion between the ink sheet and the record paper, a feed length of the record paper until release of the adhesion can be detected, and image data corresponding to this length can be deleted. Recording processing is then continued to correctly record image data upon release of the adhesion.

In addition, upon detection of adhesion between the record paper and the ink sheet, whether recording from the next page is continued can be selected.

What is claimed is:

1. A feed controller comprising:

feeding means for feeding a sheet medium;

rotary means driven in accordance with a movement of the sheet medium fed by said feeding means, said rotary means rotating an amount corresponding to a feed amount of the sheet medium;

detecting means for detecting rotation of said rotary means; and control means for determining a feed state of the sheet medium in accordance with an output from said detecting means during feeding of the sheet medium, wherein said control means causes said feeding means to operate so as to release a feed error state of the sheet medium when said control means detects the feed error state of the sheet medium.

2. A controller according to claim 1, wherein said control means outputs an alarm signal when the feed error state of the sheet medium is not released upon operation of said feeding means for a predetermined time period.

3. A controller according to claim 2, further comprising display means for performing a predetermined display in accordance with the alarm signal.

4. A controller according to claim 1, wherein said detecting means comprises a rotary member having blades and slits arranged at predetermined intervals in a circumferential direction, and a detection member for detecting the blades and the slits.

5. An image recording apparatus comprising:

feeding means for feeding a sheet medium;

recording means for recording an image on the sheet medium;

rotary means driven in accordance with a movement of the sheet medium fed by said feeding means, said rotary means rotating an amount corresponding to a feed amount of the sheet medium;

detecting means for detecting rotation of said rotary means; and control means for determining a feed state of the sheet medium in accordance with an output from said detecting means during feeding of the sheet medium and controlling said feeding means in accordance with a determination result, wherein said control means causes said feeding means to operate so as to release a feed error state of the sheet medium when said control means detects the feed error state of the sheet medium.

6. An apparatus according to claim 5, wherein said control means further controls said recording means to inhibit a recording operation during an operation of said feeding means which releases the feed error state.

7. An apparatus according to claim 6, wherein said control means selects record data corresponding to a sheet medium feed length corresponding to release of the feed error state after the feed error state is detected, and controlling said recording means to start the recording operation again.

8. An apparatus according to claim 5, wherein said control means outputs an alarm signal when the feed error state of the sheet medium is not released upon operation of said feeding means for a predetermined time period.

9. An apparatus according to claim 8, further comprising display means for performing a predetermined display in accordance with the alarm signal.

10. An apparatus according to claim 5, wherein said detecting means comprises a rotary member having blades and slits arranged at predetermined intervals in a circumferential direction, and a detection member for detecting the blades and the slits.

11. An image recording apparatus for transferring an ink of an ink sheet to a record medium to perform recording on the record medium, comprising:

recording means acting on the ink sheet to perform recording on the record medium;

ink sheet feeding means for feeding the ink sheet;

record medium feeding means for feeding the record medium; and means for detecting adhesion between the ink sheet and the record medium, wherein the ink sheet and the record medium are fed in opposite directions, and said detecting means detects the adhesion when the record medium cannot be fed in a predetermined direction even if said record medium feeding means is operated to feed the record medium by at least a predetermined amount.

12. An image recording apparatus for transferring an ink of an ink sheet to a record medium to perform recording on the record medium, comprising:

recording means for acting on the ink sheet to perform recording of the record medium;

ink sheet feeding means for feeding the ink sheet;

record medium feeding means for feeding the record medium;

means for detecting adhesion between the ink sheet and the record medium, and release means for performing a release operation for releasing of the adhesion between the ink sheet and the record medium in accordance with a detection result of the detecting means.

13. An apparatus according to claim 12, wherein said release means causes at least one of said ink sheet feeding means and said record medium feeding means to operate so as to release the adhesion between the ink sheet and the record medium when said detecting means detects the adhesion between the ink sheet and the record medium.

14. An apparatus according to claim 12, further comprising output means for outputting an alarm signal when the adhesion between the ink sheet and the record medium is not released even if said release means performs the release operation for a predetermined time period.

15. An apparatus according to claim 14, further comprising display means for performing a predetermined display on the basis of the alarm signal.

16. An image recording apparatus for transferring an ink of an ink sheet to a record medium to perform recording on the record medium in accordance with an image data, comprising:

means for receiving the image data;

converting means for decoding the image data received by said receiving means to convert the image data to a record data;

recording means acting on the ink sheet in accordance with the record data converted by said converting means to perform recording on the record medium;

ink sheet feeding means for feeding the ink sheet;

record medium feeding means for feeding the record medium;

detecting means for detecting adhesion between the ink sheet and the record medium, and release means for releasing the adhesion between the ink sheet and the record medium in accordance with an output of said detecting means.

17. An apparatus according to claim 16, further comprising:

means for counting a record medium feed length corresponding to release of the adhesion released by said release means after the adhesion is detected by said detecting means; and control means for changing a record position of the received image data in accordance with the record medium feed length counted by said counting means to control to continue reception recording.

18. An apparatus according to claim 17, wherein said release means causes at least one of said ink sheet feeding means and said record medium feeding means to operate so as to release the adhesion between the ink sheet and the record medium when said detecting means detects the adhesion between the ink sheet and the record medium.

19. An apparatus according to claim 17, further comprising output means for outputting an alarm signal when the adhesion between the ink sheet and the record medium is not released even if said release means performs the release operation for a predetermined time period.

20. An apparatus according to claim 19, further comprising display means for performing a predetermined display in accordance with the alarm signal.

* * * * *

UNITED STATES PATENT AND TRADEMARK OFFICE

CERTIFICATE OF CORRECTION

PATENT NO. : 5,430,468
DATED : July 4, 1995
INVENTOR(S) : KEIZO SASAI, ET AL.

It is certified that error appears in the above-indentified patent and that said Letters Patent is hereby corrected as shown below:

Column 1,
line 23, "h" should read --b--.

Column 7,
line 52, "8," should read --θ,--; and
line 53, "8." should read --θ.--.

Column 10,
line 11, "8" should read --θ--; and
line 32, "user when" should read --user. When--.

Signed and Sealed this

Tenth Day of October, 1995

Bruce Lehman

*Attest:*

BRUCE LEHMAN

*Attesting Officer*

*Commissioner of Patents and Trademarks*